US010358257B2

(12) United States Patent
Chasteen et al.

(10) Patent No.: US 10,358,257 B2
(45) Date of Patent: Jul. 23, 2019

(54) VENTED CONTAINER END CLOSURE

(71) Applicant: BALL CORPORATION, Broomfield, CO (US)

(72) Inventors: Howard C. Chasteen, New Port Richey, FL (US); Mark A. Jacober, Arvada, CO (US)

(73) Assignee: BALL CORPORATION, Broomfield, CO (US)

( * ) Notice: Subject to any disclaimer, the term of this patent is extended or adjusted under 35 U.S.C. 154(b) by 30 days.

(21) Appl. No.: 15/657,374

(22) Filed: Jul. 24, 2017

(65) Prior Publication Data

US 2017/0320619 A1 Nov. 9, 2017

Related U.S. Application Data

(63) Continuation of application No. 14/812,549, filed on Jul. 29, 2015, now Pat. No. 9,714,115.

(60) Provisional application No. 62/152,577, filed on Apr. 24, 2015, provisional application No. 62/030,736, filed on Jul. 30, 2014.

(51) Int. Cl.
*B65D 17/28* (2006.01)

(52) U.S. Cl.
CPC .... *B65D 17/4012* (2018.01); *B65D 2231/022* (2013.01); *B65D 2517/0094* (2013.01)

(58) Field of Classification Search
CPC ..... B65D 17/28–4012; B65D 2231/02; B65D 2231/022; B65D 2517/0001–0094
See application file for complete search history.

(56) References Cited

U.S. PATENT DOCUMENTS

| | | | | |
|---|---|---|---|---|
| 1,847,794 A | | 3/1932 | Takeda | |
| 2,160,429 A | | 5/1939 | Bukolt | |
| 2,272,111 A | | 2/1942 | Dove | |
| 3,169,678 A | | 2/1965 | Wilkinson | |
| 3,215,305 A | | 11/1965 | Frankenberg | |
| 3,221,923 A | * | 12/1965 | Bozek | B65D 17/4011 220/273 |
| 3,227,304 A | | 1/1966 | Asbury | |
| 3,246,791 A | | 4/1966 | Asbury | |
| 3,262,611 A | | 7/1966 | Palmer | |
| 3,307,737 A | | 3/1967 | Harvey et al. | |
| 3,326,406 A | | 6/1967 | Brown | |

(Continued)

FOREIGN PATENT DOCUMENTS

| | | |
|---|---|---|
| AU | 2016204140 | 8/2016 |
| CA | 2280461 | 2/2001 |

(Continued)

OTHER PUBLICATIONS

Notice of Allowance for Canada Patent Application No. 2,956,783, dated Mar. 8, 2018 1 page.

(Continued)

*Primary Examiner* — Kareen K Thomas
(74) *Attorney, Agent, or Firm* — Sheridan Ross PC

(57) ABSTRACT

A metallic container end closure is provided that generally comprises a dispensing opening and a vent opening. The vent opening improves pourability through the dispensing opening and provides an alternative option for consuming the contents of the container. The end closure may include features to ease opening of the vent opening, such as stiffeners and/or vent form features.

20 Claims, 18 Drawing Sheets

(56) References Cited

U.S. PATENT DOCUMENTS

D208,591 S 9/1967 Bozek
3,362,569 A 1/1968 Geiger
3,370,169 A 2/1968 Bozek
3,441,169 A 4/1969 Dunn et al.
3,442,416 A 5/1969 Nicholson
3,446,389 A 5/1969 Brown
3,499,573 A 3/1970 Adams
3,618,815 A 11/1971 Heffner
3,731,836 A 5/1973 Silver
3,741,432 A 6/1973 Werth et al.
3,744,667 A 7/1973 Fraze et al.
3,762,597 A 10/1973 Kaminski et al.
3,765,208 A 10/1973 Cozert
3,779,417 A 12/1973 Klein
3,794,206 A 2/1974 De Line et al.
3,807,597 A * 4/1974 Wells ..... B65D 17/166 220/277
3,826,401 A 7/1974 Zundel
3,833,144 A 9/1974 Bollmann et al.
3,836,038 A 9/1974 Cudzik
3,856,184 A 12/1974 Luviano
3,877,604 A 4/1975 Brown
3,877,606 A 4/1975 Silver
3,881,630 A 5/1975 Lovell et al.
3,908,856 A 9/1975 Perry
D238,150 S 12/1975 Cudzik
D238,659 S 2/1976 Wallace
D239,255 S 3/1976 Brincks et al.
D239,256 S 3/1976 Brincks et al.
RE28,910 E 7/1976 Dalli et al.
3,970,212 A 7/1976 Brown
3,982,657 A 9/1976 Keller et al.
4,008,823 A 2/1977 Tarro
4,024,981 A 5/1977 Brown
4,030,631 A 6/1977 Brown
4,032,034 A 6/1977 Willis
4,039,100 A 8/1977 Wells
4,051,976 A 10/1977 Perry
4,054,228 A 10/1977 Balocca et al.
4,061,243 A 12/1977 Khoury
4,062,471 A 12/1977 Perry et al.
4,073,403 A 2/1978 Orange
4,084,721 A 4/1978 Perry
4,105,133 A 8/1978 La Barge et al.
4,128,186 A 12/1978 Gane
4,146,149 A 3/1979 Beveridge
4,148,410 A 4/1979 Brown
4,184,607 A 1/1980 Potts
4,196,823 A 4/1980 Madden et al.
D255,423 S 6/1980 Bathurst
D255,424 S 6/1980 Bathurst
D255,425 S 6/1980 Bathurst
4,205,760 A 6/1980 Hasegawa
RE30,349 E 7/1980 Silver
4,210,257 A 7/1980 Radtke
4,213,538 A 7/1980 Boardman
4,244,489 A 1/1981 Klein
4,244,490 A 1/1981 Klein
4,252,247 A 2/1981 Asbury
4,257,529 A 3/1981 Saunders
4,267,938 A 5/1981 Debenham et al.
D259,403 S 6/1981 Frazier
4,276,993 A 7/1981 Hasegawa
4,280,427 A 7/1981 Potts
4,289,251 A 9/1981 Maliszewski
4,305,523 A 12/1981 Dalli et al.
4,318,494 A 3/1982 Heyn
4,320,850 A 3/1982 Drolen, Jr.
4,361,251 A 11/1982 Langseder et al.
D267,633 S 1/1983 Christian
4,387,827 A 6/1983 Ruemer, Jr.
4,397,403 A 8/1983 Guimarin
4,402,421 A 9/1983 Ruemer, Jr.
4,416,389 A 11/1983 Wilkinson et al.
4,417,668 A 11/1983 Stolle
D271,857 S 12/1983 Callahan
4,438,865 A 3/1984 Scattaregia
4,448,325 A 5/1984 Edwards et al.
4,465,204 A 8/1984 Kaminski et al.
4,576,305 A 3/1986 Saunders
4,576,306 A 3/1986 Kelsey et al.
4,577,774 A * 3/1986 Nguyen ..... B65D 17/4012 220/623
4,701,090 A 10/1987 Smith
4,796,772 A * 1/1989 Nguyen ..... B65D 17/165 220/623
4,832,223 A * 5/1989 Kalenak ..... B65D 17/163 220/623
4,901,880 A 2/1990 Tatham et al.
4,930,658 A 6/1990 McEldowney
4,994,009 A 2/1991 McEldowney
5,007,554 A 4/1991 Hannon et al.
5,011,037 A 4/1991 Moen et al.
5,064,087 A 11/1991 Koch
5,065,882 A 11/1991 Sugiyama
5,129,541 A 7/1992 Voigt et al.
5,131,555 A 7/1992 DeMars et al.
5,145,086 A 9/1992 Krause
5,190,149 A 3/1993 Krause
5,219,257 A 6/1993 Kock
5,224,618 A 7/1993 Garbiso
5,248,053 A 9/1993 Lundgren
5,285,919 A 2/1994 Recchia
5,307,947 A 5/1994 Moen et al.
D353,769 S 12/1994 Miller
5,375,729 A 12/1994 Schubert
5,397,014 A 3/1995 Aydt
5,405,039 A 4/1995 Komura
5,456,378 A 10/1995 DeMars
5,494,184 A 2/1996 Noguchi et al.
5,555,992 A 9/1996 Sedgeley
D382,481 S 8/1997 McEldowney
5,653,355 A 8/1997 Tominaga et al.
5,655,678 A 8/1997 Kobayashi
D385,192 S 10/1997 Hurst et al.
5,683,006 A 11/1997 Cook, III
D387,987 S 12/1997 Neiner
5,692,636 A 12/1997 Schubert
5,695,085 A 12/1997 Hadener
5,711,448 A 1/1998 Clarke, III
5,713,481 A 2/1998 Jordan
5,715,964 A 2/1998 Turner et al.
D396,635 S 8/1998 McEldowney
D397,296 S 8/1998 McEldowney et al.
5,819,973 A 10/1998 Traub, Sr. et al.
D402,555 S 12/1998 McEldowney et al.
D402,887 S 12/1998 Hurst
5,860,553 A 1/1999 Schubert
5,911,331 A 6/1999 Boller
5,938,390 A 8/1999 Jordan
D415,026 S 10/1999 Turner et al.
5,964,366 A 10/1999 Hurst et al.
5,975,327 A 11/1999 Funk
5,979,697 A 11/1999 Kim
6,024,239 A 2/2000 Turner et al.
6,050,440 A 4/2000 McEldowney
D424,438 S 5/2000 Turner et al.
6,059,137 A 5/2000 Westwood et al.
6,062,414 A 5/2000 Mongarli et al.
6,079,583 A 6/2000 Chasteen
6,131,763 A 10/2000 Stanish et al.
6,145,866 A 11/2000 Peter
D434,983 S 12/2000 Hurst
6,161,717 A 12/2000 Forrest et al.
6,202,880 B1 3/2001 Strube et al.
D448,666 S 10/2001 Fields
6,330,954 B1 12/2001 Turner et al.
6,354,453 B1 3/2002 Chasteen
6,375,029 B2 4/2002 Anthony et al.
6,499,329 B1 12/2002 Enoki et al.
D476,889 S 7/2003 Fields
6,715,629 B2 4/2004 Hartman et al.
6,761,281 B2 7/2004 Hartman
6,837,093 B2 1/2005 Yamasaki

(56) References Cited

U.S. PATENT DOCUMENTS 7,000,797 B2 2/2006 Forrest et al.
7,096,759 B2 8/2006 Kirko
7,100,789 B2 9/2006 Nguyen et al.
D535,561 S 1/2007 Smith et al.
D559,680 S 1/2008 Jacober et al.
D579,771 S 11/2008 Cherian
7,506,779 B2 3/2009 Jentzsch et al.
7,513,383 B2 4/2009 Hwang
7,516,869 B1 4/2009 Hajianpour
D600,116 S 9/2009 Cherian
D602,776 S 10/2009 Cherian
D612,724 S 3/2010 Cherian
7,748,557 B2 7/2010 Robinson
D623,963 S 9/2010 Fairchild et al.
7,891,519 B2 2/2011 Matsukawa et al.
7,918,359 B2 4/2011 Paris et al.
7,975,884 B2 7/2011 Mathabel et al.
D650,276 S 12/2011 Nesling et al.
D650,277 S 12/2011 Nesling et al.
D650,278 S 12/2011 Nesling et al.
D653,538 S 2/2012 Toms et al.
D653,944 S 2/2012 Seki et al.
8,136,689 B2 3/2012 Ulstein et al.
8,152,016 B2 4/2012 Berndt et al.
8,177,092 B2 5/2012 Mills
8,245,866 B2 8/2012 Gibson et al.
8,336,726 B2 12/2012 Ramsey et al.
8,397,935 B2 3/2013 Emanuele, III et al.
D691,039 S 10/2013 Jacober et al.
8,567,158 B2 * 10/2013 Chasteen ..... B65D 17/404 53/381.1
8,573,432 B2 11/2013 Emanuele, III et al.
8,627,979 B2 1/2014 Thibaut et al.
8,646,643 B2 2/2014 Forrest et al.
D704,555 S 5/2014 Hernandez
D715,144 S 10/2014 Scott
D715,647 S 10/2014 Jacober et al.
8,851,323 B2 10/2014 Watson et al.
8,893,913 B2 11/2014 McClung et al.
8,939,306 B2 1/2015 Rios
8,939,308 B2 1/2015 Ramsey et al.
8,950,619 B2 2/2015 Bork
8,978,915 B2 3/2015 Burleson, Jr.
D727,725 S 4/2015 Jacober et al.
8,998,015 B2 4/2015 Williams et al.
9,016,504 B2 4/2015 McClung et al.
9,033,174 B2 5/2015 Chasteen et al.
D731,887 S 6/2015 Keane et al.
9,051,081 B2 6/2015 Emanuele et al.
9,114,451 B2 8/2015 Chasteen et al.
9,156,585 B2 10/2015 Neiner
9,162,795 B2 10/2015 Thiemann et al.
9,181,007 B2 11/2015 Forrest et al.
9,233,784 B2 1/2016 Jacober et al.
D749,415 S 2/2016 Scott
D750,488 S 3/2016 Jacober et al.
D762,114 S 7/2016 Jacober et al.
9,403,628 B2 8/2016 Keane et al.
9,446,879 B2 9/2016 Chasteen et al.
D770,891 S 11/2016 Porter
9,694,935 B2 7/2017 Scott
9,714,115 B2 7/2017 Chasteen et al.
10,017,295 B2 * 7/2018 Chasteen ..... B65D 47/32
2002/0005408 A1 1/2002 Yamasaki et al.
2002/0113069 A1 8/2002 Forrest et al.
2002/0139800 A1 10/2002 Hwang et al.
2003/0038134 A1 2/2003 Chasteen et al.
2003/0075544 A1 4/2003 Turner et al.
2003/0098306 A1 5/2003 Cho
2003/0192889 A1 10/2003 Chasteen et al.
2004/0056032 A1 3/2004 Vaughan
2004/0140309 A1 7/2004 Thibaut
2004/0144787 A1 7/2004 Heck
2004/0188440 A1 9/2004 Schlattl et al.
2004/0211786 A1 10/2004 Turner et al.
2005/0077316 A1 4/2005 Roberts
2005/0115976 A1 6/2005 Watson et al.
2005/0224497 A1 10/2005 Wook
2006/0049196 A1 3/2006 Price
2006/0196875 A1 9/2006 Cherian
2007/0039961 A1 2/2007 McEldowney et al.
2007/0045318 A1 3/2007 Gibson et al.
2007/0068943 A1 3/2007 Ramsey et al.
2007/0108208 A1 5/2007 Dickie
2007/0138178 A1 6/2007 Erickson
2007/0175896 A1 8/2007 Bursztein
2007/0215621 A1 9/2007 Shinguryo et al.
2007/0257035 A1 11/2007 Berndt et al.
2008/0011786 A1 1/2008 Mathabel et al.
2008/0110888 A1 5/2008 Turner et al.
2008/0302793 A1 12/2008 Tirosh et al.
2009/0001081 A1 1/2009 Schlattl et al.
2009/0039090 A1 2/2009 Forrest et al.
2009/0039091 A1 2/2009 Forrest et al.
2009/0057315 A1 3/2009 Stringfield et al.
2009/0173740 A1 7/2009 Ferguson
2009/0194536 A1 8/2009 Ulstein et al.
2009/0200305 A1 8/2009 Stude
2009/0206083 A1 8/2009 Heigl
2009/0266824 A1 10/2009 Turner et al.
2009/0269169 A1 10/2009 Turner et al.
2010/0000997 A1 1/2010 Southers
2010/0018976 A1 1/2010 Christian et al.
2010/0044383 A1 2/2010 Watson et al.
2010/0224511 A1 9/2010 Boatner
2010/0251731 A1 10/2010 Bergida
2010/0258562 A1 10/2010 Linden et al.
2010/0282706 A1 11/2010 Gilliam
2010/0294771 A1 * 11/2010 Holder ..... B65D 17/4012 220/271
2010/0326281 A1 12/2010 Nishibe et al.
2011/0056946 A1 * 3/2011 Emanuele, III ..... B65D 41/32 220/271
2011/0108552 A1 5/2011 Rios
2011/0168714 A1 7/2011 Renz
2011/0226636 A1 9/2011 Petti
2011/0240645 A1 10/2011 Schley et al.
2011/0253719 A1 * 10/2011 Cherian ..... B65D 51/22 220/269
2011/0266281 A1 * 11/2011 Thiemann ..... B65D 17/4012 220/271
2011/0297679 A1 12/2011 Gogola et al.
2011/0303672 A1 12/2011 Fields et al.
2012/0012584 A1 1/2012 Chameroy et al.
2012/0048870 A1 * 3/2012 Ellerbe, III ..... B65D 17/4012 220/712
2012/0175371 A1 7/2012 Consonni
2012/0199586 A1 * 8/2012 Shamalta ..... B65D 17/4012 220/269
2012/0199587 A1 8/2012 Norris
2012/0205378 A1 8/2012 Forrest
2012/0228296 A1 9/2012 Fields
2012/0260613 A1 10/2012 Holder et al.
2012/0312815 A1 12/2012 Ramsey et al.
2013/0037542 A1 2/2013 Crothers
2013/0037543 A1 2/2013 McClung et al.
2013/0075401 A1 3/2013 Forrest
2013/0126529 A1 5/2013 Nesling et al.
2013/0264343 A1 10/2013 Neiner
2013/0264344 A1 10/2013 Neiner et al.
2013/0270267 A1 10/2013 Ramsey et al.
2013/0270269 A1 10/2013 Lewis
2013/0292382 A1 11/2013 Bork
2013/0299496 A1 11/2013 Forrest et al.
2014/0054290 A1 2/2014 McClung et al.
2014/0054332 A1 2/2014 Mcclung et al.
2014/0069924 A1 3/2014 Malaviya
2014/0103044 A1 4/2014 Ramsey et al.
2014/0110408 A1 4/2014 Mitchell et al.
2014/0158685 A1 6/2014 Thiemann et al.
2014/0263329 A1 9/2014 Chasteen et al.
2014/0263333 A1 * 9/2014 Keane ..... B65D 51/1683 220/271
2014/0325943 A1 11/2014 Fesler

(56) References Cited

U.S. PATENT DOCUMENTS

| | | | |
|---|---|---|---|
| 2014/0367382 | A1 | 12/2014 | Neiner et al. |
| 2014/0374419 | A1 | 12/2014 | Neiner |
| 2015/0001220 | A1 | 1/2015 | Neiner |
| 2015/0034648 | A1 | 2/2015 | Wilson |
| 2015/0053681 | A1 | 2/2015 | McClung et al. |
| 2015/0136776 | A1 | 5/2015 | Chasteen et al. |
| 2015/0158627 | A1 | 6/2015 | Ramsey et al. |
| 2015/0196948 | A1 | 7/2015 | McClung et al. |
| 2015/0251803 | A1 | 9/2015 | Rayburn |
| 2015/0329238 | A1 | 11/2015 | Chasteen et al. |
| 2015/0367984 | A1 | 12/2015 | Forrest et al. |
| 2016/0023801 | A1 | 1/2016 | Keane |
| 2016/0023821 | A1 | 1/2016 | Jacober et al. |
| 2016/0039563 | A1 | 2/2016 | Dunwoody |
| 2016/0052667 | A1 | 2/2016 | Gatewood et al. |
| 2016/0215377 | A1 | 7/2016 | Stone et al. |
| 2016/0236825 | A1 | 8/2016 | Mijatovic |

FOREIGN PATENT DOCUMENTS

| | | |
|---|---|---|
| CA | 2657391 | 1/2008 |
| CN | 1125679 | 7/1996 |
| CN | 201343207 | 11/2009 |
| CN | 102625769 | 8/2012 |
| EP | 0542517 | 5/1993 |
| EP | 2038178 | 10/2010 |
| ES | 2458098 | 4/2014 |
| ES | 2525589 | 12/2014 |
| GB | 1436617 | 5/1976 |
| GB | 1532081 | 11/1978 |
| GB | 2280165 | 1/1995 |
| GB | 2291030 | 1/1996 |
| GB | 2320008 | 6/1998 |
| JP | H04-311452 | 11/1992 |
| JP | H05-178345 | 7/1993 |
| JP | H05-310248 | 11/1993 |
| JP | H06-219448 | 8/1994 |
| JP | 3009188 U | 3/1995 |
| JP | H07-132936 | 5/1995 |
| JP | H07-132937 | 5/1995 |
| JP | H08-151043 | 6/1996 |
| JP | H09-58681 | 3/1997 |
| JP | H09-301364 | 11/1997 |
| JP | H10-035662 | 2/1998 |
| JP | H10-245032 | 9/1998 |
| JP | 2001-18960 | 1/2001 |
| JP | 2003-285837 | 10/2003 |
| JP | 3578797 | 10/2004 |
| JP | 2004-359339 | 12/2004 |
| JP | 2005-088961 | 4/2005 |
| JP | 2006-069605 | 3/2006 |
| JP | 2007-22541 | 2/2007 |
| JP | 2007-529374 | 10/2007 |
| JP | 2009-543737 | 12/2009 |
| JP | 2010-215291 | 9/2010 |
| JP | 4879759 | 2/2012 |
| JP | 2013-531590 | 8/2013 |
| KR | 20050059718 | 6/2005 |
| NL | 1023297 | 11/2004 |
| WO | WO 94/13544 | 6/1994 |
| WO | WO 96/02432 | 2/1996 |
| WO | WO 97/22531 | 6/1997 |
| WO | WO 97/42088 | 11/1997 |
| WO | WO 00/56613 | 9/2000 |
| WO | WO 01/46025 | 6/2001 |
| WO | WO 2008/008892 | 1/2008 |
| WO | WO 2008/023983 | 2/2008 |
| WO | WO 2008/057207 | 5/2008 |
| WO | WO 2010/046516 | 4/2010 |
| WO | WO 2011/053776 | 5/2011 |
| WO | WO 2012/018549 | 2/2012 |
| WO | WO 2012/143322 | 10/2012 |
| WO | WO 2013/022592 | 2/2013 |
| WO | WO 2013/102594 | 7/2013 |
| WO | WO 2013/102595 | 7/2013 |
| WO | WO 2013/156624 | 10/2013 |
| WO | WO 2014/031926 | 2/2014 |
| WO | WO 2014/150180 | 9/2014 |
| WO | WO 2014/152235 | 9/2014 |
| WO | WO 2015/138413 | 9/2015 |

OTHER PUBLICATIONS

Official Action with English Translation for China Patent Application No. 201580047941.3, dated Sep. 27, 2017 21 pages.
U.S. Appl. No. 29/519,461, filed Mar. 5, 2015, Jacober et al.
U.S. Appl. No. 29/545,384, filed Nov. 12, 2015, Jacober et al.
U.S. Appl. No. 15/581,932, filed Apr. 28, 2017, Scott.
"Aluminum Bottles are Here to Stay," The Packaging Insider, Dec. 28, 2011, 4 pages [retrieved from: http://thepackaginginsider.com/aluminum-bottles-coca-cola/].
"CDL End," Ball, 2016, 2 pages [retrieved from: http://www.ball.com/eu/solutions/markets-capabilities/capabilities/beverage-ends/cdl].
News Releases: "The Can, ReinVented: Louisville is Pilot Market for New Bud Light Vented Can" Anheuser-Busch InBev, Jun. 5, 2013, 3 pages.
Press Release: "Crown and Molson Coors Debut Cans with New Vented End in Canada," Crown Holdings, Inc., Jul. 11, 2013, 2 pages.
"How Ball Makes Beverage Ends," Ball, last modified Dec. 5, 2013, 1 page [retrieved from: http://www.ball.com/images/ball_com/product_options_files/How_Ball_Makes_Beverage_Ends.pdf].
"A Smoother Pour with Crown's Global Vent™," 2015, retrieved from www.crowncork.com/beverage-packaging/innovations-beverage-cans/global-vent, 2 pages.
Murray "Vented can ends give Coors a smoother pour," thedrinksreport, Jul. 12, 2013, 3 pages [retrieved from: http://www.thedrinksreport.com/news/2013/14996-vented-can-ends-give-coors-a-smoother-pour.html].
International Search Report and Written Opinion for International (PCT) Patent Application No. PCT/US15/42579, dated Oct. 28, 2015, 23 pages.
International Preliminary Report on Patentability for International (PCT) Patent Application No. PCT/US2015/042579, dated Jan. 31, 2017 9 pages.
Official Action for U.S. Appl. No. 14/812,549, dated Dec. 2, 2016 7 pages.
Notice of Allowance for U.S. Appl. No. 14/812,549, dated Mar. 15, 2016 8 pages.
Official Action for Canada Patent Application No. 2,956,783, dated Jun. 20, 2017 7 pages.

* cited by examiner

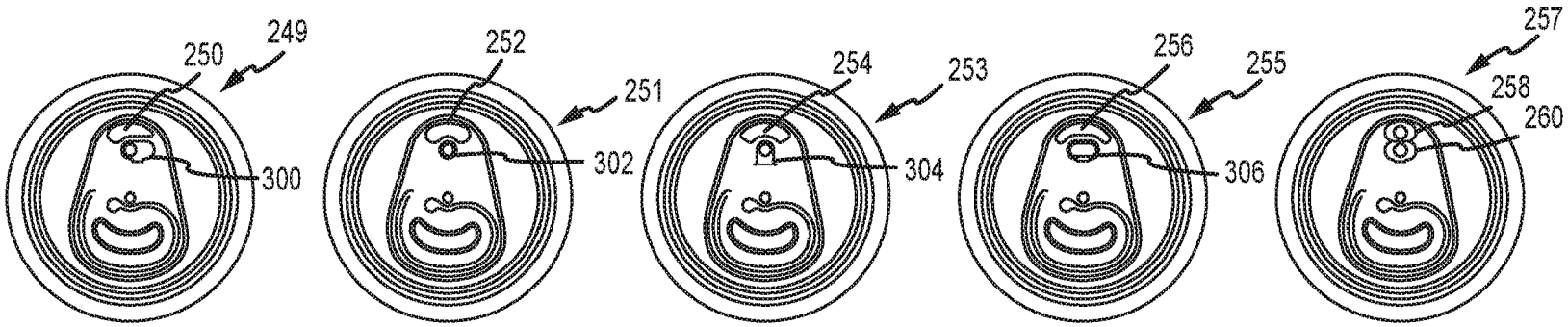
FIG.27
FIG.28
FIG.29
FIG.30
FIG.31
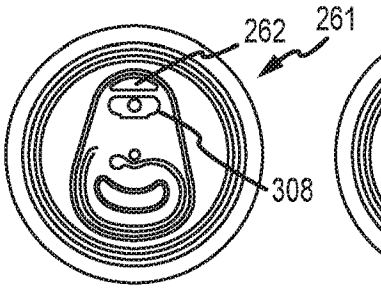
FIG.32
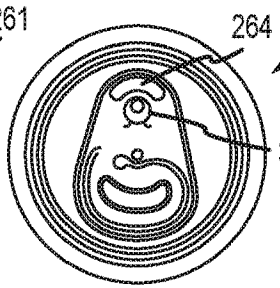
FIG.33
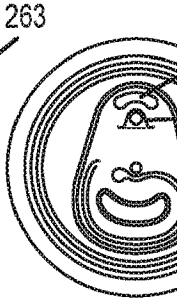
FIG.34
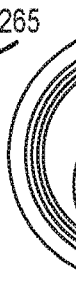
FIG.35

VENTED CONTAINER END CLOSURE

This U.S. Non-Provisional patent application is a Continuation of and claims the benefit of priority from U.S. patent application Ser. No. 14/812,549, which claims the benefit of and priority from U.S. Provisional Patent Application 62/030,736, filed Jul. 30, 2014, and U.S. Provisional Patent Application 62/152,577, filed Apr. 24, 2015, the entire disclosures of which are hereby incorporated by reference herein.

TECHNICAL FIELD

The present invention relates generally to metallic container end closures, and more particularly, to a vented metallic container end closure with a plurality of openings to provide enhanced flow and pourability.

BACKGROUND

Generally, the configuration of a container end closure affects the level to which end consumers, as well as bottlers, manufacturers, distributors, shippers, and retailers, are satisfied with a container. One factor believed to be of considerable importance to consumers is the pour characteristics of the container. In general, it is believed that consumers prefer to use containers capable of providing a relatively high and consistent pour rate. Additionally, it is believed consumers prefer containers that provide a smooth or substantially laminar pour, i.e. a pour which is not characterized by a series of surges or "glugging".

Many container configurations exist to enhance flow through a container end closure aperture. For example, some containers utilize a single large hole to admit air for venting the dispensed liquid. Examples are provided in U.S. Pat. Nos. 4,210,257; 5,007,554; 4,416,389; 4,148,410; 4,465,204; and 4,361,251; the disclosures of which are incorporated herein by reference in their entirety. Unfortunately, such larger openings tend to be associated with a higher rate of problems such as bursting, buckling, leakage, opening failures and the like, particularly when the contents are pressurized with carbonated beverages such as beer or soda. Additionally, in configurations of large openings coupled with relatively small hinge regions, container leakage and/or separation of the panel and/or other components can be a problem upon opening. In some instances, components have been expelled from the container end closure. Furthermore, such larger openings are often difficult to open or impractical to provide in container end closures which are relatively small.

In various embodiments, vent features of the present invention allow for ease of opening of a content-dispensing portion of the end closure. For example, a vent feature may be forced open prior to the opening of a primary or content-dispensing opening, thus relieving an internal pressure of the container and allowing for easier scoring and opening of the primary opening. It is also contemplated, however, that the vent feature is provided as an optional and/or secondary feature which is opened subsequent to opening of a primary feature.

In order to produce a more efficient, controlled flow rate, some containers utilize a tab or additional tool to open two or more pour openings. This increases the flow rate of the beverage and provides better control of the liquid stream. Additionally, a second vent hole may be utilized to depressurize a container, and thus allow for easier opening of the dispensing port. This is especially advantageous for carbonated and malt beverages such as beer. Examples are provided in U.S. Pat. Nos. 4,205,760; 5,307,947; 5,397,014; 6,024,239; 6,079,583; 7,513,383; 7,748,557; and U.S. Patent Application Publication Nos. 2014/0263333, 2010/0294771 and 2011/0056946; the disclosures of which are incorporated herein by reference in their entirety. However, many prior art end closures with a vent opening may be opened with finger pressure alone and utilize a score residual with a thickness which is prone to prematurely severing, and thus causing leaks or failures during stacking.

In various known devices, inadvertent depression of a pull tab such as that which may occur during handling, stacking, shipping, etc. may result in inadvertent opening of a vent feature, thus ruining the container and contents. Other vent openings utilize a score with excessive score residual, thus making the vent difficult to open without a secondary tool.

SUMMARY

Thus, there exists a need to provide a container end closure that provides enhanced pour characteristics through an easy-opening vent feature, while minimizing the likelihood of problems such as bursting, buckling, leakage, opening failures, and the like. Further, there exists a need to provide vent openings which can be opened with a portion of the pull tab, yet prevents inadvertent opening and a positive "ball détente" assembly which identifies proper engagement.

The present invention is generally directed to systems and methods which provide metallic container end closures with a plurality of openings for improved venting and pour characteristics. The present disclosure discusses opening configurations utilizing various numbers, positions, shapes, sizes, and orientations of openings. These configurations are presented herein for description purposes and are not intended to limit the scope of the invention.

In accordance with one embodiment of the present invention, a metallic container end closure is provided that comprises a primary opening and a secondary vent opening. The number of openings may vary in number, size, shape, location, and orientation. In some embodiments, a primary opening provides an aperture for pouring the contents of the container, and a secondary vent opening provides ventilation for air flow through the end panel for enhancing pouring characteristics. In some embodiments, a single primary dispensing opening is provided, and a plurality of vent openings are provided. The plurality of vent openings may provide apertures to vent the container to enhance product flow out of the dispensing opening, to dispense the product at varying flow rates, to accommodate a straw, and/or to allow multiple consumers to drink out of the same container without contacting the same part of the container end closure.

In addition to varying the number of openings, the size of the openings may vary. Larger openings may be included in an end closure to provide a consumer with a faster dispensing rate. Smaller openings may be included to provide container venting, thus depressurizing the container and providing enhanced pourability. Additionally, smaller openings may be used to dispense contents at a slower rate, which may be advantageous for children. Smaller openings also may be configured to selectively accommodate straws. Such configurations may be desirable for children as the smaller opening reduces the flow rate during spills and the use of a straw may increase the likelihood that the child will drink the product. In one embodiment, a large dispensing opening for dispensing the product and a small vent opening for venting the container is provided. In another embodiment, a large dispensing opening and a large vent opening is provided. In this embodiment, the consumer has two substantially equivalent dispensing options.

Various opening shapes are contemplated. For example, the opening shapes may be circular, square, bulbous, triangular, curved, arcuate, oval, and other shapes known in the art. Further, the shapes may be symmetrical or non-symmetrical about an axis that bisects the opening area. The shape of the opening may be chosen based on the desired flow rate and the ease of fracturing an associated score. For example, a score with a triangular shape has a stress concentration at the apex of the triangle, thus reducing the amount of force necessary to fracture the score near the apex. Additionally, a triangular shape will allow an opening tool to focalize the opening force on a smaller area near the apex as opposed to a round score shape.

The location of the openings on the end closure may vary as well. In some embodiments, a dispensing opening and a vent opening is provided. In these embodiments, the vent opening is selectively located on the container end closure so that when a container is tipped to dispense its contents out of the dispensing opening, the contents do not exit out of the vent opening. This selective location prevents spillage out of the vent opening while dispensing product out of the dispensing opening, and the location increases the smoothness of the pour by providing adequate container venting.

The orientation of the openings also may vary. In one embodiment, a vent opening is provided on or proximal to a center line of an end closure, the center line generally bisecting the primary opening, a tab provided on the end closure, and the vent opening. The vent opening is positioned within an open area or void in the tab proximal to user-activated end of the tab. The vent is severable and activated by rotating the tab from an original position and depressing a portion of the tab into an upper surface of the vent feature. The vent feature preferably comprises a raised feature or dome to facilitate opening of the vent feature. A portion of the tab may comprise a détente or downwardly extending portion for contacting and opening the vent feature. This allows a consumer to move the pull tab into the proper position for severing the score of the vent opening without needing to visually identify the location of the tab.

In alternative embodiments, a vent opening is provided offset from a centerline of the closure. Such embodiments include embodiments wherein the vent opening is provided outside of an area defined by a tab when the end closure is provided in a filled and closed state. Although preferred embodiments of the present disclosure comprise a vent opening located on an opposite side of a rivet from a main opening, the present disclosure is not limited to only that embodiment. Rather, it is contemplated that the vent be provided radially offset from such a position, such that a rotation of the tab of between approximately 5 and 120 degrees is required to allow a tail of the tab to contact the vent portion.

In various embodiments, end closures are contemplated which comprise a stiffening bead or a local vent recess to assure sufficient stiffness within the metal surrounding the vent, thus assuring ease of opening. Local vent recesses comprise a deboss or recess provided on an end closure, wherein the vent is provided within or proximal to the vent recess. Vent recesses of the present disclosure may be provided in any number of locations, including within a main deboss, external to a main deboss, or provided as an extension to a main deboss. As used herein, a main deboss generally refers to a deboss on a central panel and within which at least a main opening area and a rivet are provided. Such main deboss features include, but are not limited to Stolle-type debosses.

In various embodiments, the present disclosure comprises an end closure with a vent opening and/or a vent score line having a preferred geometry. Such embodiments contemplate the vent score being provided in any number of positions, including underneath a tail of a tab when a container is in a closed position, or alternatively positioned off-set from the tab when the container is in a closed position. In certain embodiments, a vent is provided comprising a non-circular vent score line. For example, in certain embodiments, a vent is provided with a score line comprising a generally elongate or flat oval form. In preferred embodiments, the generally elongate oval comprises substantially parallel opposing portions and arcuate, mirrored, opposing portions. Furthermore, the hinge point of the vent opening may be positioned in a variety of locations, including proximate to the side next to the rivet, proximate to the peripheral curl or on either end of the oval.

In various embodiments, end closures are provided comprising a vent opening feature, the vent opening feature comprising a vent score line and an upstanding contact feature provided at least partially within the vent score line. In certain embodiments, the upstanding contact feature comprises a domed member provided on a vent panel, the domed member suitable for contacting with a portion of a tab such as the tail and/or bead of a tab. Such features may be provided on any number of embodiments shown and described herein, and regardless of the location of the vent on the end panel.

In a preferred embodiment, an end closure with a vent feature is provided on a central panel of the end closure. The end closure comprises a main recess or deboss, with a primary opening at least partially defined by a score line provided therein. The central panel further comprises a rivet, and a stay-on tab secured thereto, the tab comprising a nose portion and a tail portion. The end closure further comprises a vent opening, the vent opening positioned opposite the rivet with respect to the primary opening. The vent opening comprises a vent score line characterized by a flat oval shape. The vent score line comprises first and second substantially parallel score lines spaced apart from one another and joined at corresponding ends by arcuate or semi-circular scores. Although the vent score as described herein is occasionally referred to as comprising distinct elements, such description is provided for illustrative purposes only. It will be recognized that the vent score line comprises a continuous score feature with different radii of curvature and/or linear portions.

It is an object of various embodiments of the present invention to provide a raised vent feature that is provided within an aperture of a tab, at least when the vent feature and the tab are provided in a first position and wherein the first position comprises a closed position of the end closure with the primary opening portion and vent feature sealed.

In accordance with another aspect of the present invention, a metallic container end closure is provided that reduces the difficulty of opening a vent opening. In some embodiments, a stiffening structure is provided that adds stiffness to the deboss area near a secondary score. The stiffening structure may have various shapes and configurations. For example, the stiffening structure may be a raised or recessed portion of the deboss area, such as a bead. Alternatively, the stiffening structure can be a separate element that is coupled to the deboss. By adding stiffness to the deboss near a secondary score, the stiffening structure will reduce deboss deflection and thus any downward force exerted on a secondary gate will be focused on the secondary score. Thus, the opening force required to fracture the secondary score is reduced. Further, in some embodiments, a vent form feature is provided that increases the stiffness of the deboss near a secondary score and provides a seat for an opening tool. In these embodiments, the vent form feature may have various shapes and configurations. For example, the vent form feature may be a raised or recessed portion of the deboss, such as a ramp. Alternatively, the vent form feature can be a separate element that is coupled to the deboss. By adding stiffness to the deboss near a secondary score, the vent form feature reduces the opening force required to fracture a secondary score. By providing a seat for an opening tool, the vent form feature reduces slippage and increases force transfer from an opening tool to a secondary gate associated with a vent opening. Moreover, in some embodiments, a safety fold provides additional stiffness around a vent opening.

In addition to reducing opening force, the stiffening structures improve opening distance. The stiff panel resists deflection allowing the vent feature panel to be forced further into the can thus creating a larger opening.

While various embodiments of the present invention contemplate providing a primary opening and a vent opening feature within or on a deboss area of an end closure, it will be expressly recognized that the present invention is not limited to such embodiments. Indeed, it is contemplated that in certain embodiments, the vent feature is provided external to the deboss area. In preferred embodiments, the vent feature is provided within a radius defined by a pull tab and extending from a rivet that secures the pull tab. However, alternative embodiments are contemplated wherein the vent feature is provided outside of such a radius.

In accordance with another aspect of the present invention, a metallic container end closure is provided that reduces the chances of a consumer injury. In some embodiments, a tab is provided that comprises a downwardly projecting (i.e. projecting or extending from the tab toward the end closure when the tab and end closure are provided in an assembled state) feature that is rotationally offset from the vent feature when the tab is provided in a first position as described above, and wherein the downwardly projecting feature is adapted to communicate with and apply force to the vent opening feature when the tab is rotated to an opening position.

As discussed herein, the container and associated container end closure generally is formed of conventional metallic container materials, such as aluminum. However, a container end closure according to certain embodiments of the present invention can be formed of other materials including other metals or metal alloys, plastics, cardboard, paper, fiber reinforced materials, and the like.

In various embodiments of the present invention, an end closure with a vent feature is provided wherein the vent feature is openable with a tab, the tab being secured to the end closure by a rivet. In such embodiments, no additional or external tools are required to open the vent feature.

In preferred embodiments of the present invention, a pull tab is provided that at least partially surrounds, covers, or otherwise protects a vent feature. The pull tab, at least when provided in a first position, thereby protects the vent from being inadvertently opened during stacking, shipping, handling, etc.

In certain embodiments, a location-identifier is provided on the pull tab, such that when the tab is rotated to a position wherein the tab may be used to break open the vent feature, feedback is provided to a user regarding this position. In preferred embodiments, a vent feature is provided on the end closure such that only a small degree of rotation is required to move the tab from a closed or secured position to a position wherein the tab is provided for opening the vent feature.

In certain embodiments, a vent opening is provided within a debossed area of an end closure, thus further protecting the vent from inadvertent opening and/or contact, and allowing indicia or other features to be provided on the central panel of the closure.

In one embodiment, a vented metallic end closure adapted for interconnection with a container body is provided, the end closure comprising a peripheral curl, a chuck wall extending downwardly from the peripheral curl, a countersink interconnected to a lower end of the chuck wall, a central panel interconnected to the countersink, a deboss connected to the central panel, and a tab interconnected to the deboss and rotatable about a rivet. The deboss has a primary score defining a dispensing opening and a secondary score defining a vent opening. The tab comprises an aperture, the aperture having a diameter equal to or larger than a diameter of the secondary score and adapted to provide visual feedback related to the vent opening. The tab comprises a vent interface portion adapted to contact the vent opening, and wherein the vent interface portion is adapted to transmit a force applied to the tab to the vent opening and break open the secondary score. The vent opening further comprises a hinge portion about which the vent portion may hinge open.

In one embodiment, the present invention comprises a method of opening a container end closure, the method comprising the steps of: 1) lifting a pull or tail portion of a tab to force a nose portion of the tab into a primary opening; 2) rotating the tab such that a vent interface portion of the tab is aligned with a vent feature; 3) applying a force to the tab to break open the vent feature; and 4) rotating the tab back to an initial rotational position and visually confirming that the vent feature has been opened.

In an alternative embodiment, the vent feature is opened prior to an opening of primary opening. For example, in one embodiment, a method comprises opening a container end closure by: 1) rotating the tab such that a vent interface portion of the tab is aligned with a vent feature; 2) applying a force to the tab to break open the vent feature; 3) rotating the tab back to an initial rotational position; and 4) lifting a tail portion of a tab to force a nose portion of the tab into a primary opening. This opening sequence may be enhanced by removing pressure within the container after the vent opening is severed, thus requiring less force to open the primary opening.

In one embodiment, a vented metallic end closure adapted for interconnection to a neck of a container body is provided. The end closure comprises a peripheral curl, a chuck wall extending downwardly from the peripheral curl, a countersink interconnected to a lower end of the chuck wall, a central panel interconnected to the countersink, a deboss provided on the central panel, and a tab interconnected to the deboss and rotatable about a rivet. The deboss comprises a first recess, a primary score that defines a dispensing opening, and a vent opening that comprises a secondary score. The dispensing opening and the vent opening are provided in opposing relationship on opposite sides of the rivet. A secondary recess is provided within the deboss and adjacent to the secondary score. In preferred embodiments, the secondary recess extends at least partially around the secondary score. The tab comprising a nose end and a pull end, the pull end comprises an aperture that is adapted to provide visual feedback of the vent opening. The aperture is preferably slightly larger than an upstanding feature provided on the vent opening, and smaller than the vent opening itself.

The pull end of the tab is adapted to contact the vent opening and transmit a force to the vent opening and sever the secondary score. The secondary score comprises first and second linear portions, the first and second linear portions being substantially parallel, and first and second opposed arcuate portions to form a flat-oval shape. The vent opening comprises a raised feature and a vent hinge, and the vent hinge is provided proximal to the rivet such that the vent opening hinges in an opposite direction as the dispensing opening.

The Summary is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary as well as in the attached drawings and the Detailed Description and no limitation as to the scope of the present invention is intended by either the inclusion or non-inclusion of elements, components, etc. in this Summary. Additional aspects of the present invention will become more readily apparent from the Detail Description, particularly when taken together with the drawings.

BRIEF DESCRIPTION OF THE DRAWINGS

FIG. 27 is a top plan view of an end closure with a vent feature according to one embodiment of the present disclosure.

FIG. 28 is a top plan view of an end closure with a vent feature according to one embodiment of the present disclosure.

FIG. 29 is a top plan view of an end closure with a vent feature according to one embodiment of the present disclosure.

FIG. 30 is a top plan view of an end closure with a vent feature according to one embodiment of the present disclosure.

FIG. 31 is a top plan view of an end closure with a vent feature according to one embodiment of the present disclosure.

FIG. 32 is a top plan view of an end closure with a vent feature according to one embodiment of the present disclosure.

FIG. 33 is a top plan view of an end closure with a vent feature according to one embodiment of the present disclosure.

FIG. 34 is a top plan view of an end closure with a vent feature according to one embodiment of the present disclosure.

FIG. 35 is a top plan view of an end closure with a vent feature according to one embodiment of the present disclosure.

Figure 1:
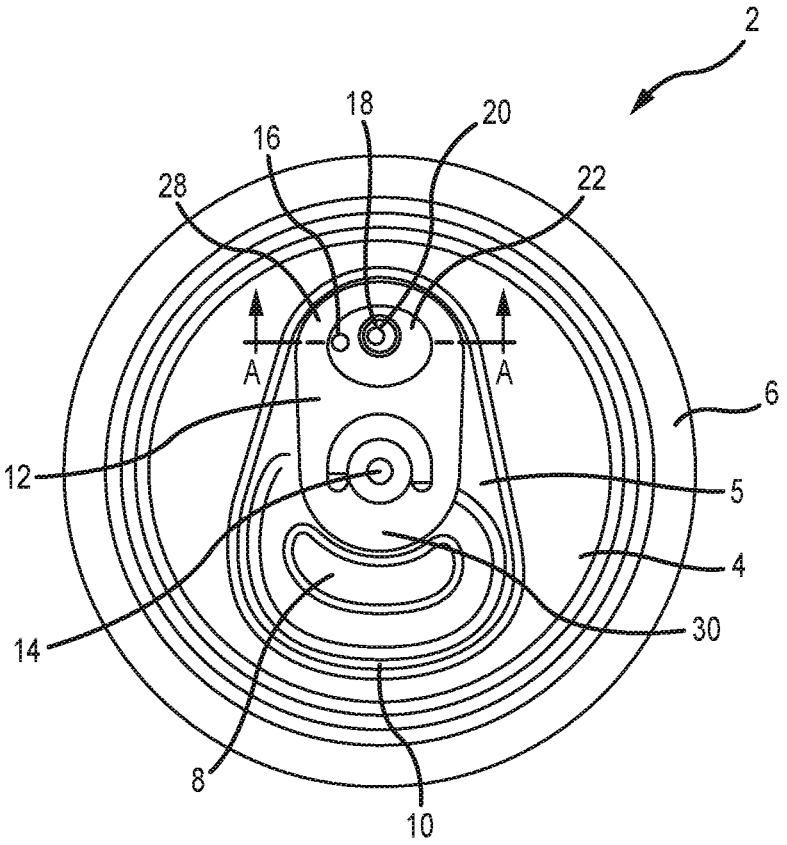
FIG. 1 is a top plan view of an end closure according to one embodiment of the present invention.

To assist in the understanding of the drawings, the following is a list of components and associated numbering found in the drawings:

| # | Components |
|---|---|
| 2 | End closure |
| 4 | Central panel |
| 5 | Deboss |
| 6 | Peripheral curl |
| 8 | Primary opening |
| 10 | Primary score |
| 12 | Tab |
| 14 | Rivet |
| 16 | Vent protuberance |
| 18 | Tab orienting feature |
| 20 | Vent opening |
| 22 | Vent cover portion |
| 24 | Dome feature |
| 26 | Vent orienting feature |
| 28 | Tail portion |
| 30 | Nose portion |
| 32 | Hinge |
| 34 | Vent score |
| 36 | First tier |
| 38 | Second tier |
| 40 | First tier |
| 42 | Second tier |
| 50 | End closure |
| 52 | Peripheral curl |
| 54 | Countersink |
| 56 | Central Panel |
| 58 | Primary opening |
| 60 | Primary score |
| 62 | Rivet |
| 64 | Secondary vent |
| 66 | Vent panel |
| 68 | Upstanding domed feature |
| 70 | Vent score |
| 72 | Anti-fracture score |
| 74 | Stiffening bead |
| 76 | Primary recess |
| 78 | Vent hinge |
| 80 | End closure |
| 82 | Peripheral curl |
| 84 | Countersink |
| 86 | Central panel |
| 88 | Primary opening |
| 90 | Primary score |
| 92 | Rivet |
| 94 | Secondary vent |
| 96 | Vent panel |
| 98 | Upstanding dome portion |
| 100 | Vent score |
| 102 | Anti-fracture score |
| 104 | Stiffening bead |
| 106 | Main recess |
| 108 | Vent hinge |
| 120 | End closure |
| 122 | Peripheral curl |
| 124 | Countersink |
| 126 | Central panel |
| 128 | Main recess |
| 130 | Primary opening |
| 132 | Primary score |
| 134 | Rivet |
| 136 | Secondary recess |
| 138 | Vent feature |
| 140 | Anti-fracture feature |
| 142 | Vent score |
| 144 | Upstanding dome portion |
| 146 | Vent hinge |
| 200 | Aperture |

-continued

| # | Components |
|---|---|
| 220 | Vent feature |
| 222 | Vent score |
| 224 | Raised feature |
| 226 | Vent hinge |
| 230 | Vent feature |
| 232 | Vent score |
| 234 | Raised feature |
| 236 | Vent score |
| 240 | Vent feature |
| 242 | Vent score |
| 244 | Raised feature |
| 246 | Vent score |
| 249 | End closure |
| 250 | Secondary recess |
| 251 | End closure |
| 252 | Secondary recess |
| 253 | End closure |
| 254 | Secondary recess |
| 255 | End closure |
| 256 | Secondary recess |
| 257 | End closure |
| 258 | Vent feature |
| 260 | Vent feature |
| 261 | End closure |
| 262 | Secondary recess |
| 263 | End closure |
| 264 | Secondary recess |
| 265 | End closure |
| 266 | Secondary recess |
| 267 | End closure |
| 268 | Secondary recess |
| 270 | End closure |
| 272 | Panel |
| 274 | Peripheral curl |
| 276 | Deboss |
| 278 | Primary opening |
| 280 | Primary score |
| 282 | Vent feature |
| 284 | Vent score |
| 286 | Vent hinge |
| 288 | Dome portion |
| 290 | Secondary recess |
| 292 | Rivet |
| 294 | Tab access feature |
| 300 | Vent feature |
| 302 | Vent feature |
| 304 | Vent feature |
| 306 | Vent feature |
| 308 | Vent feature |
| 310 | Vent feature |
| 312 | Vent feature |
| 314 | Vent feature |

DETAILED DESCRIPTION

FIG. 1 is a top plan view of one embodiment of an end closure 2 according to the present invention. FIG. 1 depicts the end closure 2 in a first position, wherein the first position comprises a closed position prior to opening of the primary opening 8 or vent feature 20. The end closure 2 comprises a central panel 4, a peripheral curl 6 for securing the end closure to the neck of a container, and a tab 12 interconnected to the deboss 5 by a rivet 14. The deboss 5 comprises a primary opening 8 which is severable at a primary score line 10 to open the primary opening 8 and allow for container contents to be dispensed. A vent feature 20 is provided on an opposing side of the rivet 14 from the primary opening portion 8. The vent feature 20 is visible through and exposed by a tab orienting feature 18 in the arrangement and position depicted in FIG. 1. The tab orienting feature 18 of the depicted embodiment comprises an aperture or through hole in the tab 12. The tab orienting feature 18 is depicted as comprising a generally circular opening in FIG. 1, but it will be expressly recognized that various shapes and sizes for the tab orienting feature 18 are contemplated. In various embodiments, it is contemplated that the tab orienting feature 18 comprises the same or similar shape as the vent feature 20 and wherein the tab orienting feature 18 comprises a slightly larger dimension of similar shape as the vent 20. However, the present invention is not so limited and various sized and shapes are contemplated for use with the tab orienting feature 18.

In FIG. 1, the vent feature 20 is visible through the tab orienting feature 18. Thus, a user or consumer can readily see that the vent 20 is closed and available for opening. In addition to providing visual information on the vent 20, the tab orienting feature 18 also provides a recess that prevents force transmission to the vent 20 in the event that the tab 12 is depressed during shipping, stacking, etc. of filled containers. The tab 12 is rotatable by grasping a tail portion 28 of the tab and forcing a nose portion 30 of the tab into the primary opening 8, as will be recognized by one of ordinary skill in the art. Before or after the primary opening 8 is activated, the tab 12 may be rotated about a longitudinal axis of the container extending through the rivet 14 to align a vent protuberance 16 provided on the tab 12 with the vent 20. In certain embodiments, the vent protuberance 16 comprises a détente or downwardly projecting feature of the tab for positioning over the vent feature 20 and transmitting a force to open the feature, as shown and described herein. Although FIGS. 1-3 depict the primary opening 8 as being closed during vent opening operations, it will be expressly recognized that the present invention contemplates first opening the primary opening 8 prior to opening the vent feature 20.

The tab 12 of the depicted embodiment comprises a vent cover portion 22. Various known tabs comprise a pull-ring style device, with a void provided in the region depicted as the vent cover portion 22 of FIGS. 1-3. In contrast with such prior art devices, the embodiment of FIGS. 1-3 provide a vent cover portion that comprises a solid portion of the tab 12 with a vent protuberance 16 and tab orienting feature 18 are provided thereon. In an alternative embodiment, however, a large aperture is provided in lieu of the vent covering portion, and a vent protuberance 16 is provided on a remainder of the tab 12.

Figure 2:
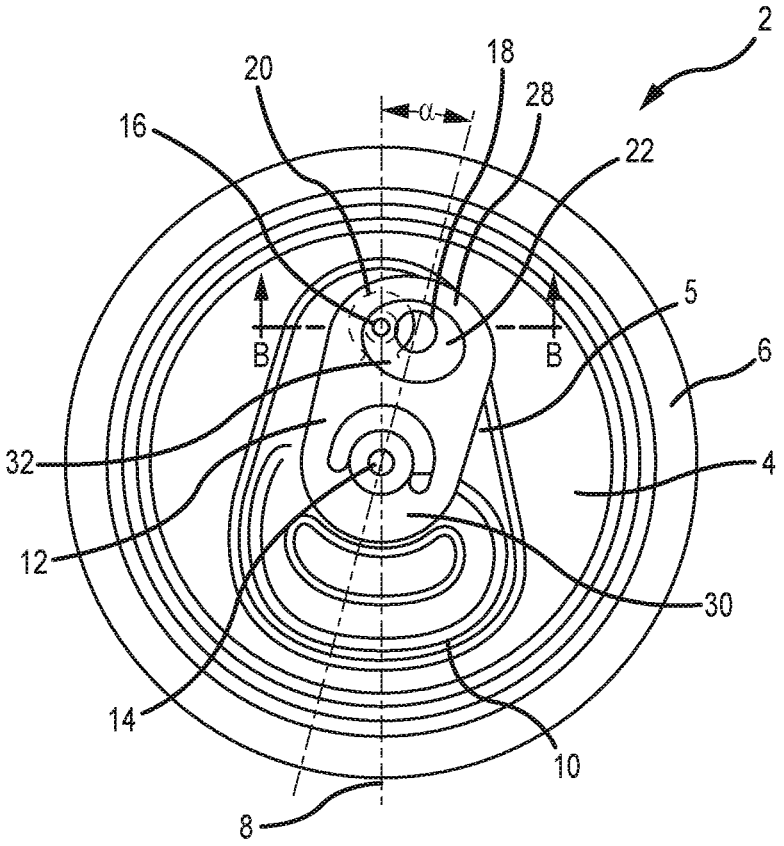
FIG. 2 is a top plan view of the end closure shown in FIG. 1 with the pull tab rotated in a clockwise direction.
Figure 3:
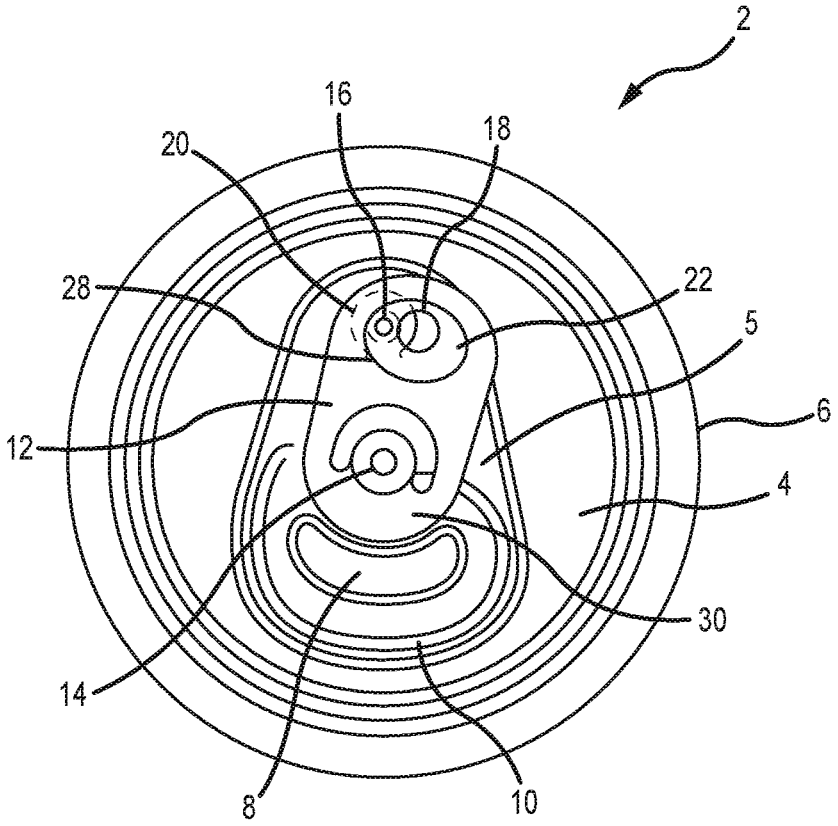
FIG. 3 is a top plan view of an end closure according to one embodiment of the present invention.

FIG. 2 is a top plan view of an end closure 2 according to the embodiment of FIG. 1 wherein the tab 12 has been rotated to a position suitable for opening the vent 20. As shown, the tab 12 has been rotated about an axis extending through the rivet 14 such that the tab orienting feature has been moved radially away from the vent 20 and the vent protuberance 16 of the tab is positioned over the vent 20. Thus, in the position depicted in FIG. 2, a downward force applied to the tab 12 will be transmitted through the tab 12 and the vent protuberance 16 to the vent portion 20. The vent portion may thus be opened by said force, which severs a score line defining the vent, and wherein the vent 20 is openable about a hinge 32.

As further shown in FIG. 2, an offset angle $\alpha$ is provided. The offset angle $\alpha$ is the angle of rotation required to translate the tab 12 from a first closed position to a second position wherein the second position is adapted for opening the vent protuberance 16. In various embodiments, the offset angle $\alpha$ is contemplated as being between approximately 5 degrees and approximately 30 degrees. In preferred embodiments, the offset angle $\alpha$ is contemplated as being between approximately 10 degrees and approximately 25 degrees. In one preferred embodiment, the offset angle $\alpha$ is contemplated as being at least approximately 15 degrees and preferably no greater than approximately 20 degrees. Although FIG. 2 depicts an end closure with a tab 12 rotated in a clockwise direction, certain embodiments provide that the tab 12 should preferably rotated in a counterclockwise direction. Where a vent feature is opened prior to opening the primary opening 8, subsequent attempts at opening the primary opening 8 with the tab 12 still provided in the position of FIG. 2 may cause complications with the opening of the primary opening 8 including tongue tear and hinge fracture. Therefore, in certain embodiments the present disclosure provides methods and devices wherein opening of the vent requires counter-clockwise rotation of the tab, including embodiments wherein a vent feature is provided in a position that requires such rotation in order for a tail portion of the tab to contact the vent feature.

FIG. 3 is a top plan view of an end closure 2 according to the embodiment of FIGS. 1-2 and wherein the vent opening 20 has been opened. When rotated back to the position of FIG. 1, the tab orienting feature 18 provides visual information to a user that the vent feature 20 has been opened and is ready for venting and facilitating pouring of contents through the primary opening 8 by enhancing air flow characteristics.

Figure 4:
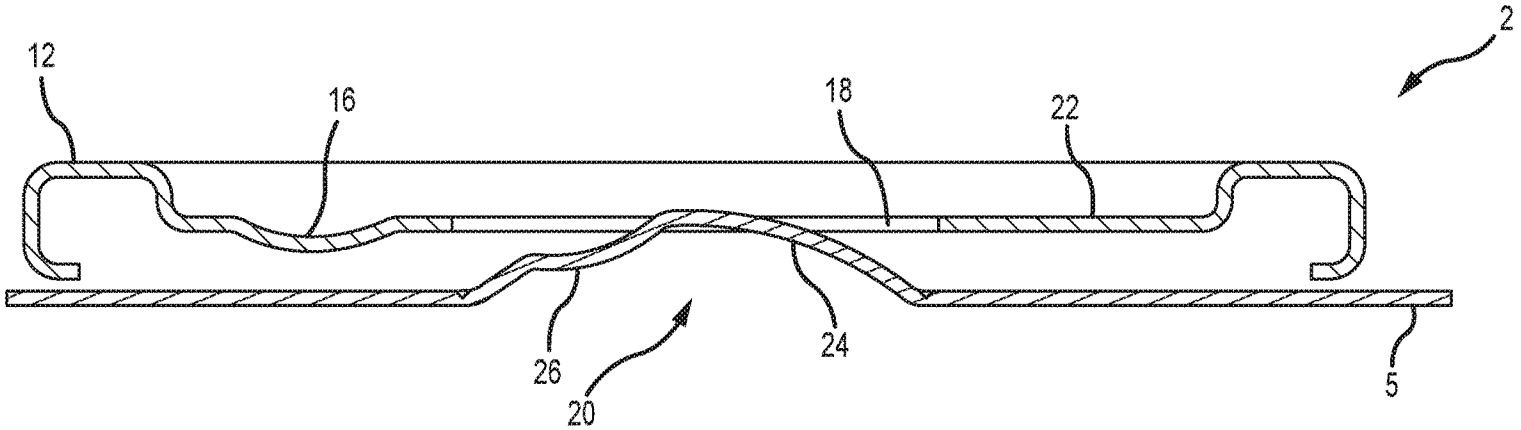
FIG. 4 is a cross-sectional elevation view of an end closure taken at line A-A of FIG. 1.
Figure 5:
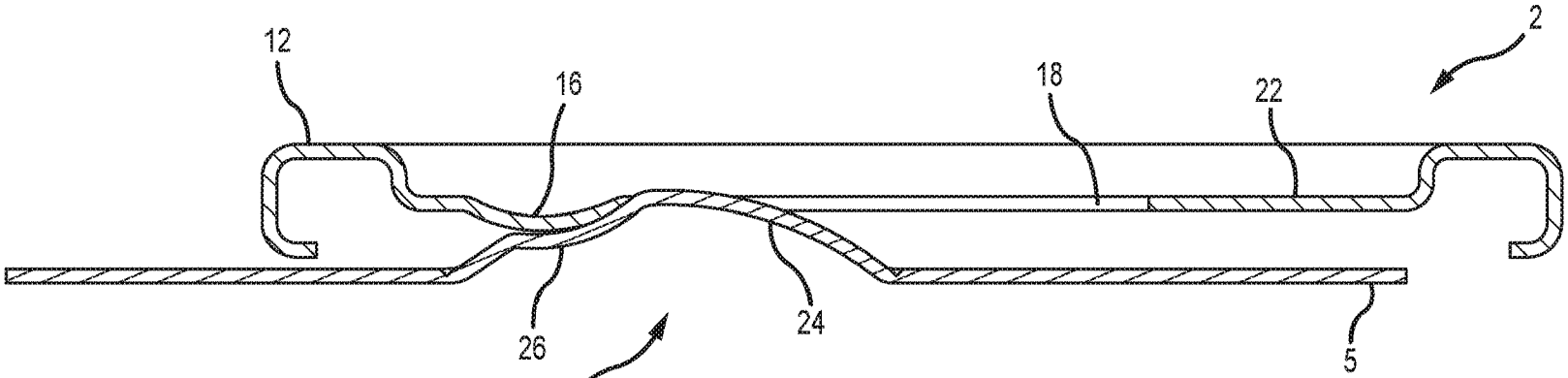
FIG. 5 is a cross-sectional elevation view of an end closure taken at line B-B of FIG. 2.

FIGS. 4-5 are cross-sectional elevation views of an end closure 2 according to one embodiment of the present invention in first and second positions, respectively. FIG. 4 is a cross-section taken about line A-A of FIG. 1 depicting the end closure 2 with a vent feature 20 provided on the deboss 5. The vent feature 20 comprises a generally convex protrusion 24 with a concave portion 26. The concave portion 26 is provided to receive and communicate with vent protuberance 16 as shown and described herein. In the position depicted in FIG. 4, the tab orienting feature 18 is disposed directly over the vent opening 20. As shown, the vent cover portion 22 is provided radially outwardly from the tab orienting feature and the vent opening 20. The tab orienting feature comprises an opening or void in the tab 12. Thus, if the tab 12 and/or vent cover portion 22 is depressed or deflected downwardly, the vent 20 is not accidentally depressed or broken open.

FIG. 5 is a cross-sectional view of the end closure 2 taken about line B-B of FIG. 2, wherein the tab 12 has been rotated such that the vent protuberance 16 is provided in contact with the concave portion 26 of the vent opening 20. The relative position of the tab 12 and vent feature 20 shown in FIG. 5 are provided for opening the vent feature 20. Specifically, a downward force applied to the tab 12 as provided in FIG. 5 will force open the vent 20.

Figure 6:
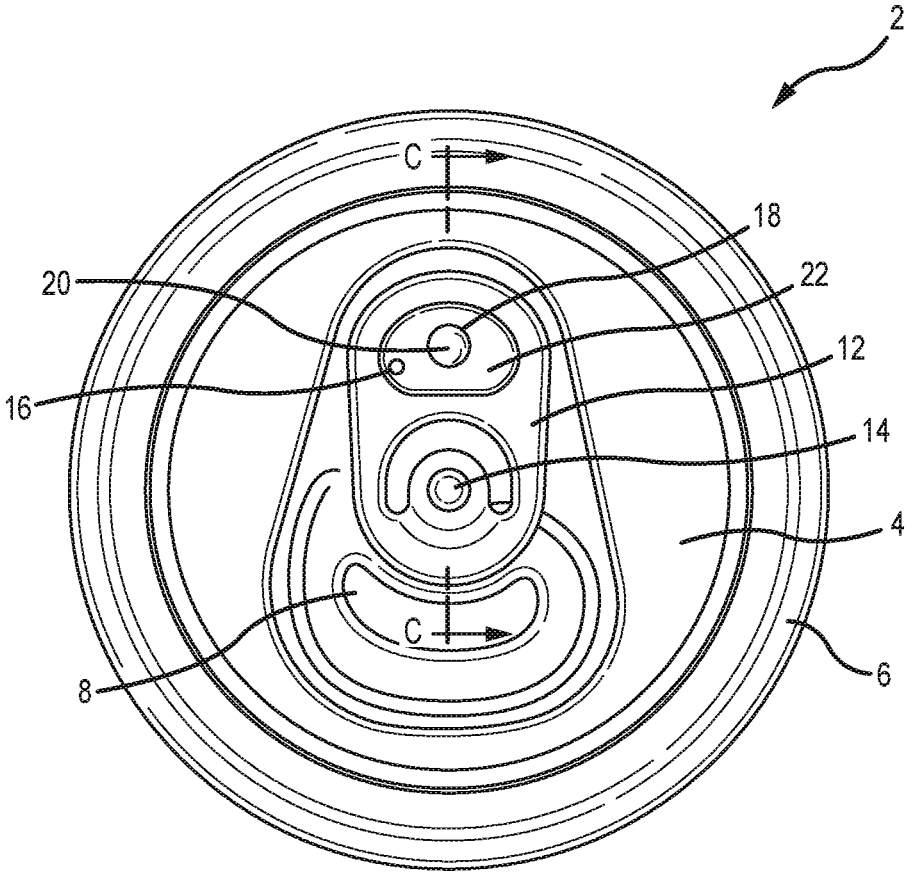
FIG. 6 is a top plan view of an end closure according to an alternative embodiment of the present invention.
Figure 7:
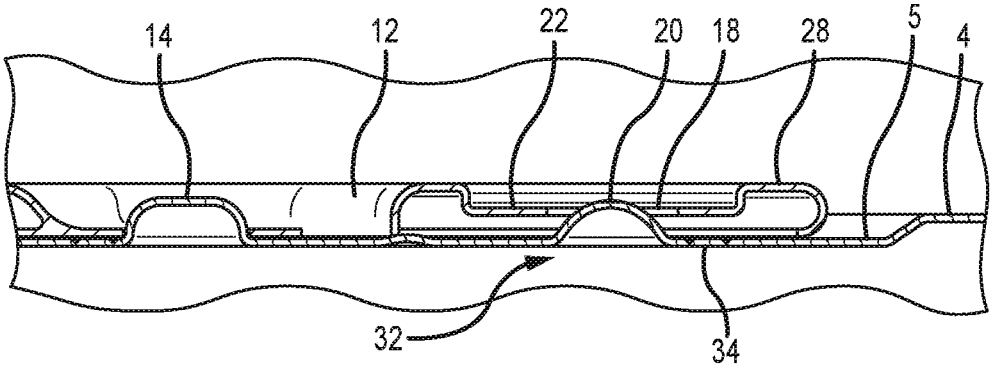
FIG. 7 is a cross-sectional elevation view of the end closure of FIG. 6 taken at line C-C.
Figure 8:
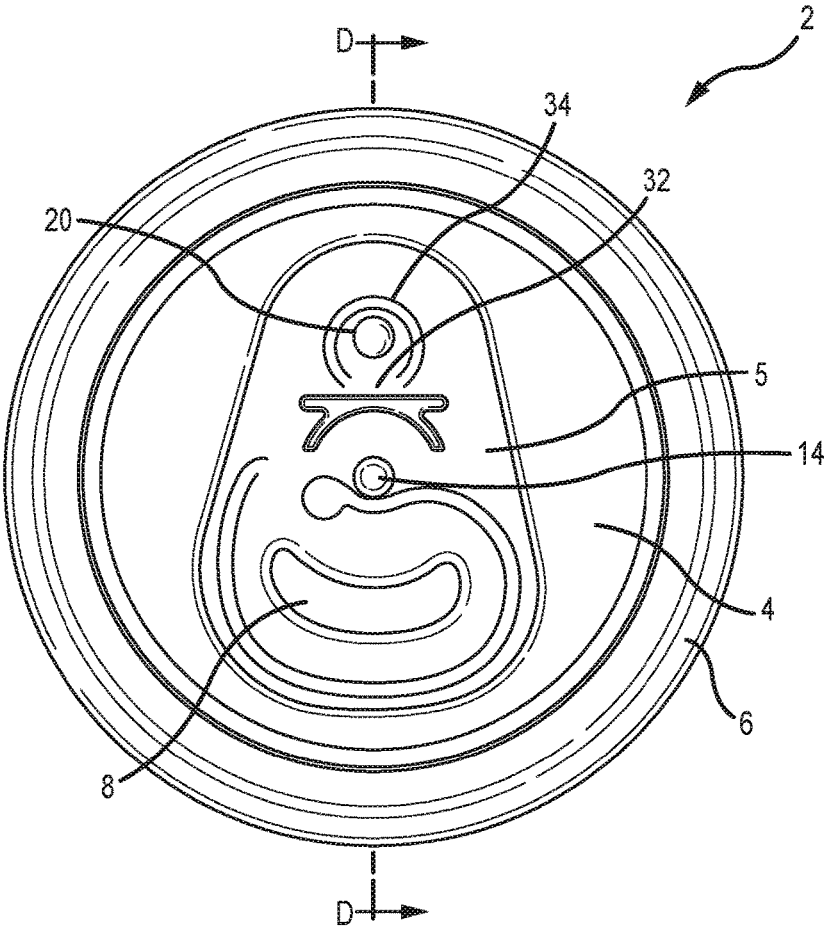
FIG. 8 is a top plan view of the end closure shown in FIG. 6 with the pull tab removed.
Figure 9:
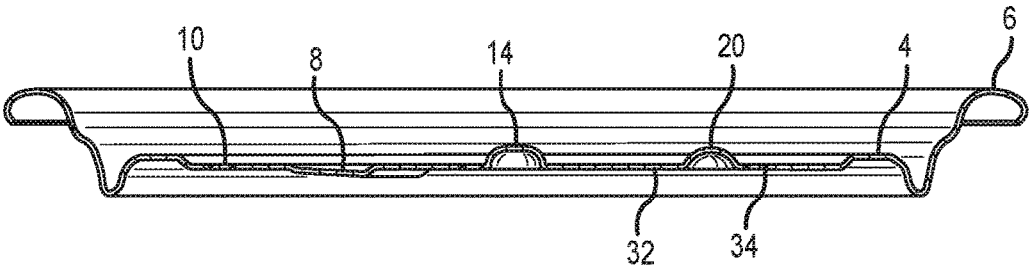
FIG. 9 is a cross-sectional elevation view of the end closure of FIG. 8 taken at line D-D.

FIGS. 6-9 depict one embodiment of an end closure 2 with a vent feature 20. FIGS. 6-7 depict the end closure with a tab 12 operable to open the vent feature 20, and FIGS. 8-9 depict an end closure of the same embodiment with the tab 12 removed. FIG. 6 is a top plan view of an end closure 2 according to one embodiment of the present invention wherein a tab 12 is provided, the tab 12 operable to open a dispensing opening 8 and a vent feature 20. In the position of FIG. 6, the vent feature 20 is disposed beneath a tab orienting feature 18. The tab 12 further comprises a vent interface portion 16 provided on a vent cover portion 22. The tab 12 is rotatable about a rivet 14 such that the vent protuberance 16 may be disposed over or in contact with the vent feature 20. The tab 12 and vent protuberance 16 may be forced downwardly to apply a force to and break open the vent feature 20. FIG. 7 is a cross-sectional elevation view of the end closure 2 taken about line C-C of FIG. 6. As shown in FIG. 7, the tab orienting feature 18 comprises an aperture or void in the vent cover portion 22 of the tab 12. In the closed position of FIG. 7, wherein the tab orienting feature 20 is provided over and substantially concentric with the vent 20, it will be recognized that a downward force applied to the tab 12 will generally not impact or break open the vent 20.

FIG. 8 is a top plan view of the end closure of the embodiment of FIG. 6. FIG. 9 is a cross-sectional elevation view taken at line D-D of FIG. 8. FIGS. 8-9 depict the end closure without the tab, and thus reveal various score lines. The vent feature 20 comprises a vent score line 34 adapted to be broken open when a tab 12 is used to apply a force to the vent feature 20. The score 34 is generally circular in the depicted embodiment, but is not a closed circle as a hinge portion 32 is provided to connect the vent 20 to the central panel 4 and allow the vent 20 to hinge open. Although the vent hinge 32 is provided at a location generally between the vent 20 and the rivet 14, it will be expressly recognized that the hinge 32 may be provided at any number of radial positions with respect to the vent 20.

Figure 10:
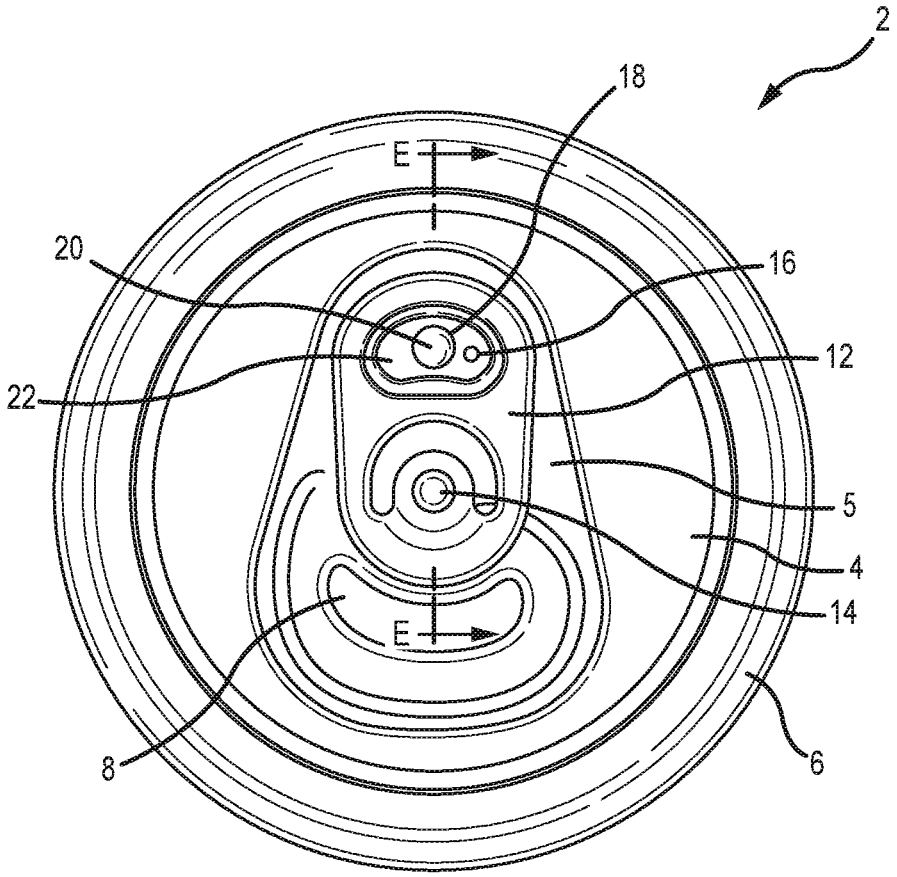
FIG. 10 is a top plan view of an end closure according to one embodiment of the present invention, and showing the tab, the primary opening and the vent opening in a closed position.
Figure 11:
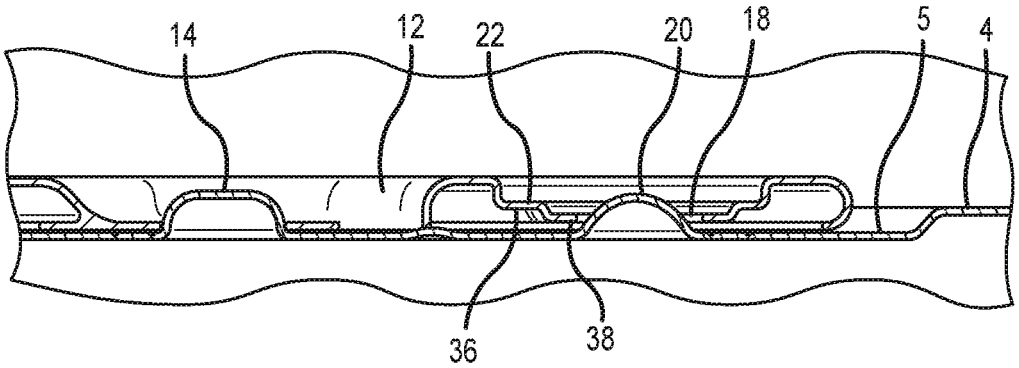
FIG. 11 is a cross-sectional elevation view of an end closure according to the embodiment of FIG. 10 and taken about line E-E.

FIGS. 10-11 depict an end closure 2 according to one embodiment of the present invention. FIG. 10 is a top plan view of the end closure 2. FIG. 11 is a cross-sectional elevation view of the end closure 2 taken at line E-E of FIG. 10. The embodiment of FIGS. 10-11 comprises a vent cover portion 22 having a tab orienting feature 18 and a vent interface portion 16. The vent cover portion 22 of the depicted embodiment comprises a stepped or tiered structure with a first tier 36 and second tier 38 as shown in FIG. 11. The vent interface portion 16 is provided in an alternative position wherein the tab must be rotated counter-clockwise from the position shown in FIG. 10 to utilize the vent interface portion 16. It will be recognized that the vent interface portion 16 may be provided in a number of different positions.

Figure 12:
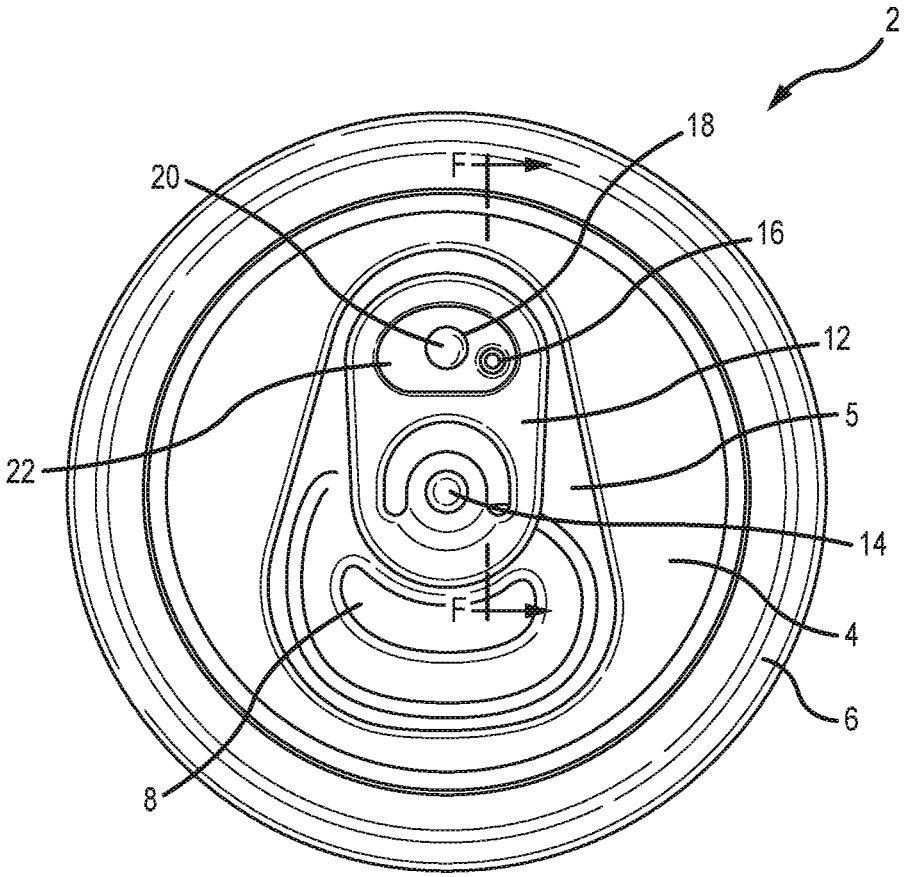
FIG. 12 is a top plan view of an end closure according to one embodiment of the present invention, and showing the tab, the primary opening and the vent opening in a closed position.
Figure 13:
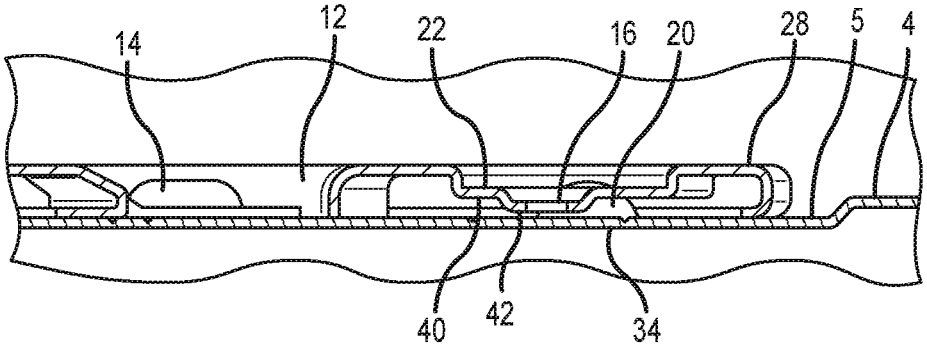
FIG. 13 is a cross-sectional elevation view of an end closure according to the embodiment of FIG. 12 and taken about line F-F.

FIGS. 12-13 depict an end closure 2 according to one embodiment of the present invention. FIG. 12 is a top plan view of the end closure 2. FIG. 13 is a cross-sectional elevation view of the end closure 2 taken at line F-F of FIG. 12. The embodiment of FIGS. 12-13 comprises a vent cover portion 22 having a tab orienting feature 18 and a vent interface portion 16. The vent interface portion 16 of the depicted embodiment comprises a stepped or tiered structure with a first tier 40 and second tier 42 as shown in FIG. 13.

Figure 14A:
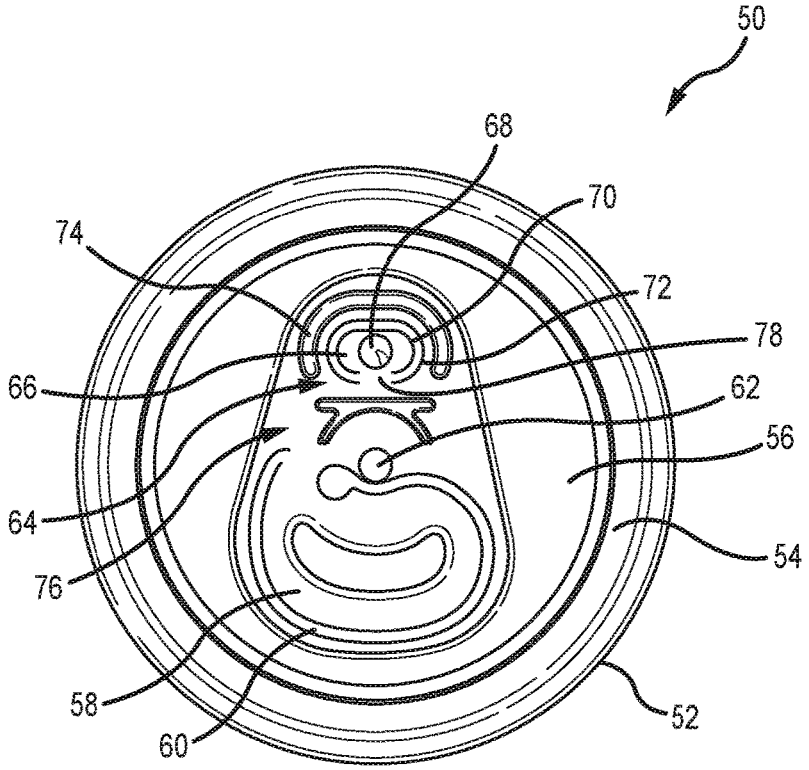
FIG. 14A is a top plan view of an end closure according to one embodiment of the present disclosure.

FIG. 14A is a top plan view of an end closure according to one embodiment of the present invention. As shown, the end closure 50 comprises a peripheral curl 52 for securing the end closure to a container body, and a countersink 54. The end closure 50 comprises a central panel 56 located interior to the countersink 54. The central panel 56 comprises a main deboss or recess 76 within which a primary opening area 58 is provided. The primary opening area 58 comprises a tear panel for opening the end closure and allowing the container contents to be dispensed. The primary opening area 58 comprises a main score 60, which is severable by applying a force to the opening area 58 with the nose of a tab (not shown) secured to the end closure 50 at a rivet 62. The end closure 50 further comprises a secondary opening or vent feature 64. In the depicted embodiment, the vent feature 64 comprises a substantially flat oval shape. The vent feature 64 further comprises a vent score 70 and an anti-fracture feature 72. The vent feature 64 further comprises a vent hinge 78 about which the vent feature rotates during an opening operation. The vent feature 64 further comprises an upstanding dome portion 68 adapted for contact with a tail end of the tab (not shown) to force open the vent feature. In certain embodiments, and as shown in FIG. 14A, the end closure 50 further comprises a stiffening bead 74. The bead 74 may be provided to stiffen the panel 56, or to account for slack metal created during the formation of the vent score 70 and/or the anti-fracture score 72. The bead 74 of FIG. 14A comprises a geometry wherein the bead 74 extends only partially around the vent feature 64. In alternative embodiments, the end closure is devoid of the bead 74, and the end closure 50 comprises a vent feature 64 provided within a main recess 76 and the end closure 50 is devoid of additional beads or similar features (i.e. apart from main recess 76).

Figure 14B:
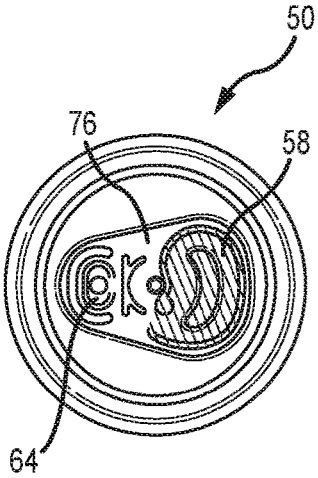
FIG. 14B is a top plan view of the end closure of the embodiment of FIG. 14A.
Figure 14C:
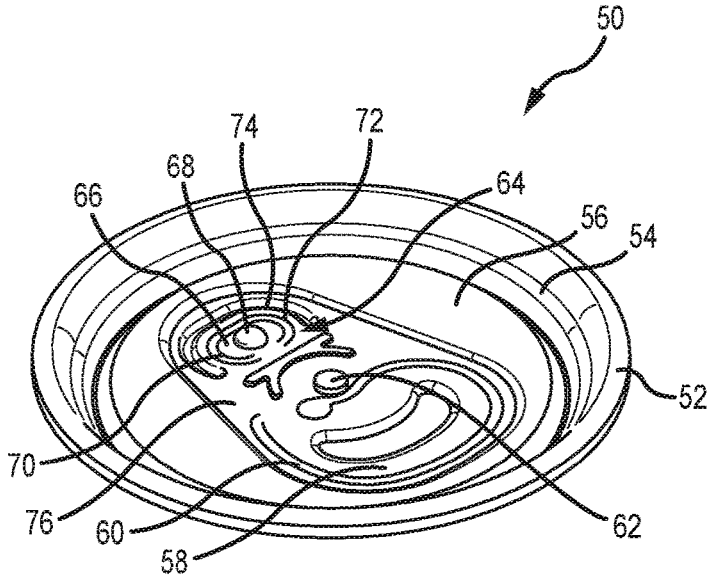
FIG. 14C is a top perspective view of the end closure of the embodiment of FIG. 14A.

FIGS. 14B-14C are top plan and top perspective views of the end closure 50 according to the embodiment of FIG. 14A. FIG. 14B, as shown, depicts an end closure with a primary opening area 58 comprising an aperture area of between approximately 0.25 square inches and approximately 1.0 square inch, and preferably approximately 0.56 square inches.

Figure 15A:
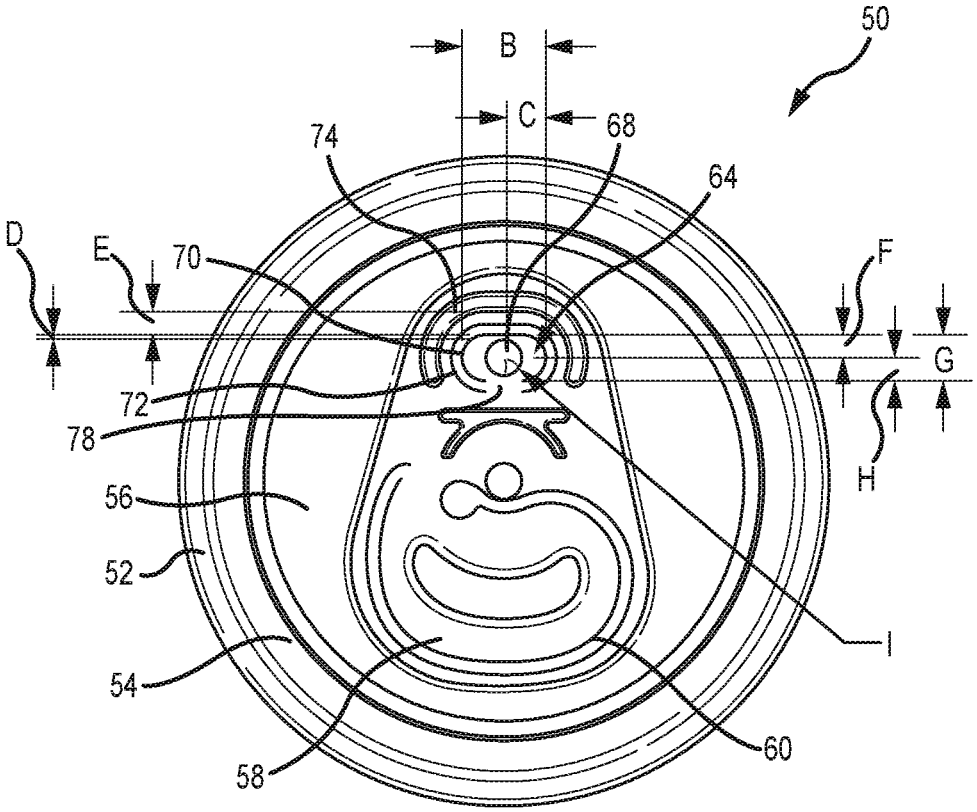
FIG. 15A is a top plan view of the end closure of the embodiment of FIG. 14A.
Figure 15B:
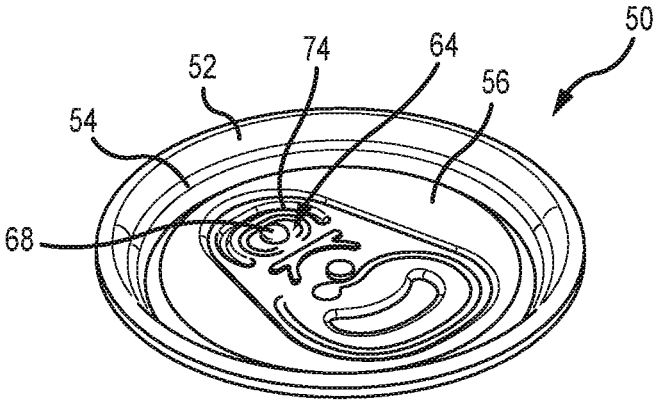
FIG. 15B is a top perspective view of the end closure of the embodiment of FIG. 14A.

FIG. 15A is a top plan view of the end closure 50 according to the embodiment of FIG. 14A and comprising exemplary dimensions. More specifically, as appreciated by one of skill in the art, the dimensions may be varies based on the size of the end closure, size of the primary opening, and other factors. As shown, an end closure 50 is provided with a vent feature 64 provided within a main deboss 76. The vent score 64 comprises a width B of between approximately 0.125 inches and approximately 0.50 inches, and preferably between approximately 0.300 inches and 0.350 inches. The vent score 70 comprises a height G (provided substantially perpendicular to the width) that is between approximately 0.10 and 0.20 inches, and preferably approximately 0.165 inches from the hinge 78 to the score line 70. In various embodiments, and as shown in FIG. 15A, a portion of the vent score 70 is provided proximal to an edge of the upstanding dome portion 68. As shown, a portion of the vent score 70 is offset from an edge of the upstanding dome portion by a gap D, wherein the gap D is less than approximately 0.025 inches from an edge of the upstanding dome portion 68. Preferably, the gap D comprises a distance of between approximately 0.012 inches and 0.014 inches. As shown, the vent feature 64 generally comprises a flat oval shape with a vent hinge 78 provided between the rivet and the upstanding dome portion 68. In the depicted embodiment, the vent feature 64 is adapted to hinge inwardly toward a product side of the end closure 50 and wherein score propagation begins at a point on the vent score 70 opposite the dome portion 68 with respect to the rivet.

As further shown in FIG. 15A, the vent score 70 is offset from a secondary recess 74 in the form of a stiffening bead by a dimension E. In various embodiments, the dimension E comprises a distance of between approximately 0.075 and 0.10 inches, and preferably of approximately 0.083 inches. A distance F between a center point of the dome portion 68 and a portion of the vent score 70 preferably comprises a distance of between approximately 0.070 inches and 0.090 inches, and more preferably comprises a distance of approximately 0.078 inches. A distance between the vent hinge 78 and a center point of the dome portion 68 is shown as dimension H, wherein dimension H preferably comprises a distance of between approximately 0.070 and 0.10 inches, and preferably of between approximately 0.077 and 0.087 inches. A first width G of the vent feature 64 comprises a width of between approximately 0.140 and 0.180 inches, and preferably of between approximately 0.155 and 0.165 inches. A lateral distance C is provided between a center point of the dome portion 68 and a portion of the vent score 70, wherein the lateral distance C comprises a distance of between approximately 0.140 inches and 0.180 inches, and preferably of between approximately 0.150 and 0.175 inches. The dome portion 68 comprises a width I of between approximately 0.10 and 0.20 inches, and preferably of between approximately 0.128 and 0.132 inches. The width I generally comprises a dimension across the dome portion 68 between opposing intersections of the dome portion and the vent panel. In certain embodiments, the dome portion 68 comprises a hemisphere. In such embodiments, the width I comprises a diameter of the dome portion 68. In alternative embodiments, however, it is contemplated that dome portion 68 is not a complete hemisphere and/or is provided on the vent panel such that a distance across the base of the dome portion 68 does not comprise a diameter.

The embodiment of FIGS. 14A-15B comprises a secondary recess 74 in the form of a stiffening bead extending at least partially around the vent feature 64. The secondary recess 74 is provided to account for slack metal created during formation of the vent score 70 and anti-fracture feature 72 and/or is provided as an access point for an underside of a tail portion of a tab (not shown). Although various embodiments of an end closure are provided herewith that comprise a secondary recess, additional embodiments of the present disclosure contemplate an end closure that is devoid of a secondary recess. For example, the vent feature of any one or more of the various embodiments shown and described herein may be provided wherein no secondary recess is provided, at least in connection with the vent feature.

FIGS. 16A-17B depict an end closure 80 comprising numerous features as shown and described herein with respect to FIGS. 14A-15B, including a peripheral curl 82, countersink 84, central panel 86, main opening area 88, opening area score line 90, a rivet 92, a main deboss 106, and a vent feature 94 comprising a vent panel 96, an upstanding domed portion 98, vent score 100, anti-fracture score 102, and a vent hinge 108. A stiffening bead 104 is provided generally adjacent to the vent feature 94. The stiffening bead is provided to account for slack metals, provide strength to the end closure, and/or allow for access to an underside of the tab.

Figure 17A:
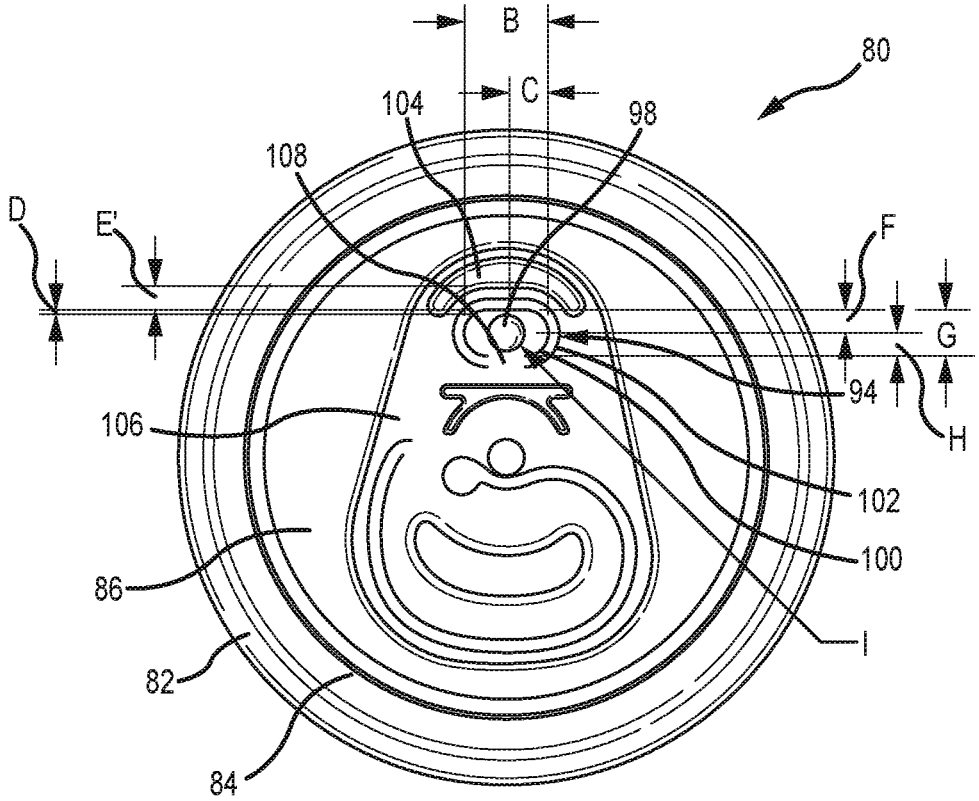
FIG. 17A is a top plan view of the end closure of the embodiment of FIG. 16A.
Figure 17B:
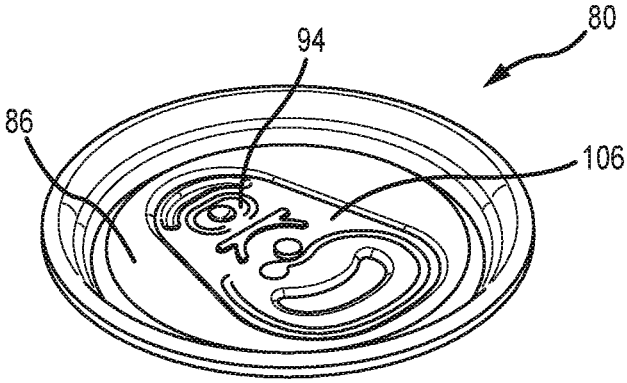
FIG. 17B is a top perspective view of the end closure of the embodiment of FIG. 16A.

As further shown in FIG. 17A, the vent score 100 is offset from a secondary recess 104 in the form of a stiffening bead by a dimension E'. In various embodiments, the dimension E' comprises a distance of between approximately 0.075 and 0.10 inches, and preferably of approximately 0.083 inches. A distance F between a center point of the dome portion 98 and a portion of the vent score 100 preferably comprises a distance of between approximately 0.070 inches and 0.090 inches, and more preferably comprises a distance of approximately 0.078 inches. A distance between the vent hinge 108 and a center point of the dome portion 98 is shown as dimension H, wherein dimension H preferably comprises a distance of between approximately 0.070 and 0.10 inches, and preferably of between approximately 0.077 and 0.087 inches. A first width G of the vent feature 94 comprises a width of between approximately 0.140 and 0.180 inches, and preferably of between approximately 0.155 and 0.165 inches. A lateral distance C is provided between a center point of the dome portion 98 and a portion of the vent score 100, wherein the lateral distance C comprises a distance of between approximately 0.140 inches and 0.180 inches, and preferably of between approximately 0.150 and 0.175 inches. The dome portion 98 comprises a width I of between approximately 0.10 and 0.20 inches, and preferably of between approximately 0.128 and 0.132 inches. The width I generally comprises a dimension across the dome portion 98 between opposing intersections of the dome portion and the vent panel. In certain embodiments, the dome portion 98 comprises a hemisphere. In such embodiments, the width I comprises a diameter of the dome portion 98. In alternative embodiments, however, it is contemplated that dome portion 98 is not a complete hemisphere and/or is provided on the vent panel such that a distance across the base of the dome portion 98 does not comprise a diameter.

FIGS. 18A-19B depict an end closure 120 according to one embodiment of the present disclosure. As shown, the end closure 120 comprises a peripheral curl 122 for securing the end closure to a container body, and a countersink 124. The end closure 120 comprises a central panel 126 located interior to the countersink 124. The central panel 126 comprises a main deboss or recess 128 within which a primary opening area 130 is provided. The primary opening area 130 comprises a tear panel for opening the end closure and allowing container contents to be dispensed. The primary opening area 130 comprises a main score 132, which is severable by applying a force to the opening area 130 with the nose of a tab (not shown) secured to the end closure 120 at a rivet 134.

Figure 18A:
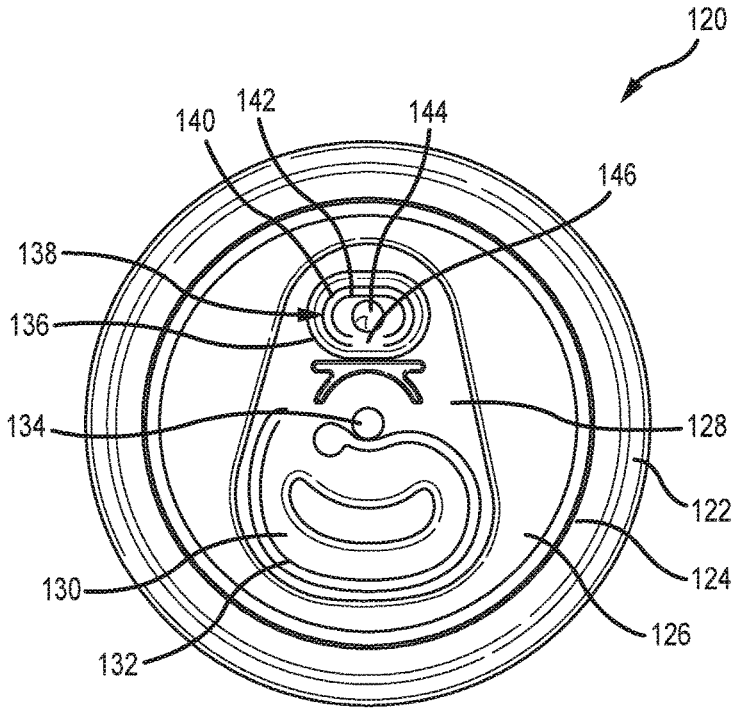
FIG. 18A is a top plan view of an end closure according to one embodiment of the present disclosure.

The end closure 120 further comprises a secondary opening or vent feature 138. In the depicted embodiment, the vent feature 138 comprises a substantially flat oval shape. The vent feature 138 comprises a vent score 142 and an anti-fracture feature 140. The vent feature 138 further comprises a vent hinge 146 about which the vent feature rotates during an opening operation. The vent feature 138 further comprises an upstanding dome portion 144 adapted for contact with a tail end of the tab (not shown) to force open the vent feature. In certain embodiments, and as shown in FIG. 18A, the end closure 120 further comprises a vent recess 136. The vent recess 136 may be provided to stiffen the panel 56, or to account for slack metal created during the formation of the vent score 142 and/or the anti-fracture score 140. The vent recess 136 of FIG. 18A comprises a recess that substantially surrounds and contains the vent feature 138. The vent feature 138 of the depicted embodiment is provided completely within the main recess 128. Alternative embodiments contemplate the vent recess 136 being provided external to the main recess 128 or as an extension of the main recess 128.

Figure 18B:
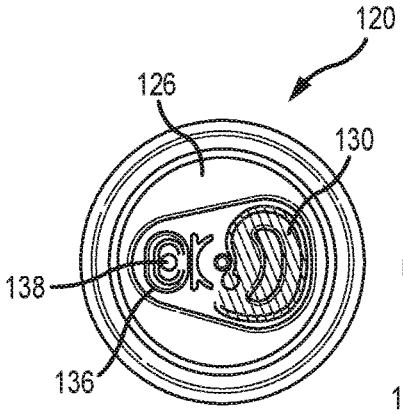
FIG. 18B is a top plan view of the end closure of the embodiment of FIG. 18A.
Figure 18C:
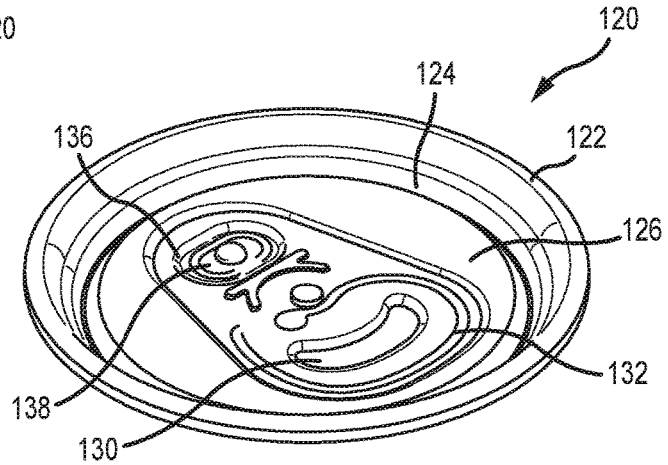
FIG. 18C is a top perspective view of the end closure of the embodiment of FIG. 18A.

FIGS. 18B-18C are top plan and top perspective views of the end closure 120 according to the embodiment of FIG. 18A. FIG. 18B, as shown, depicts an end closure with a primary opening area 130 comprising an aperture area of between approximately 0.25 square inches and approximately 1.0 square inches, and preferably approximately 0.56 square inches.

Figure 19A:
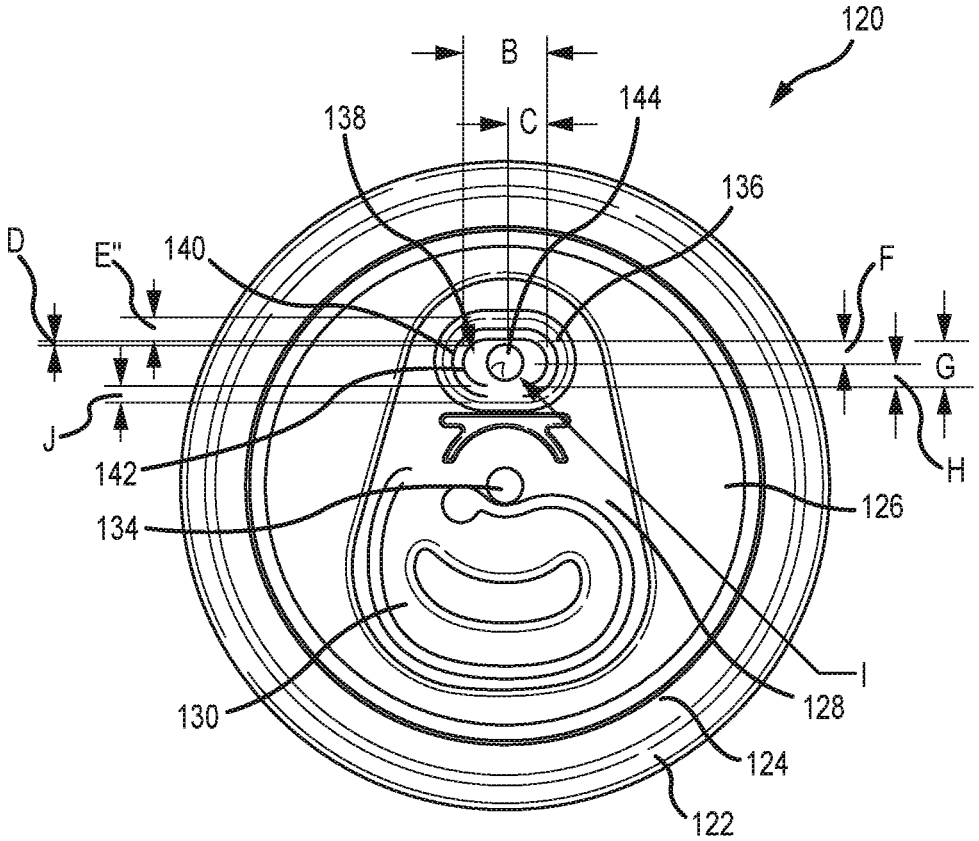
FIG. 19A is a top plan view of the end closure of the embodiment of FIG. 18A.
Figure 19B:
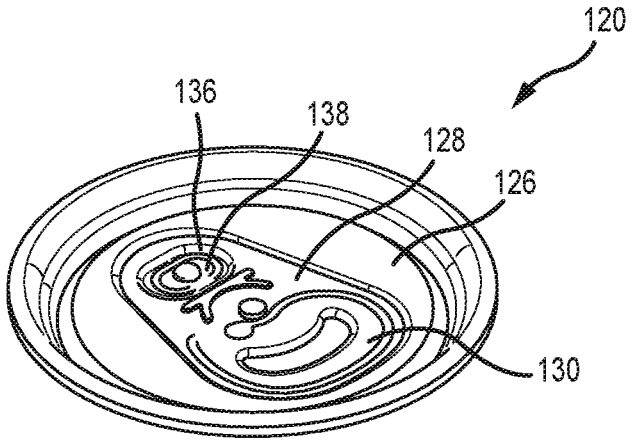
FIG. 19B is a top perspective view of the end closure of the embodiment of FIG. 18A.

FIG. 19A is a top plan view of the end closure 120 according to the embodiment of FIG. 18A. The dimensions provided in FIG. 18A are provided for illustrative purposes of one particular embodiment of the present disclosure. Exemplary dimensions as shown herein with respect to FIG. 19A and other figures are provided to illustrate specific embodiments of the disclosure. The inventions discussed herein are not limited to the depicted dimensions. As shown, an end closure 120 is provided with a vent feature 138 provided within a main deboss 128. The vent score 142 comprises a width of between approximately 0.125 inches and approximately 0.50 inches, and preferably approximately 0.350 inches. The vent score 142 comprises a height (provided substantially perpendicular to the width) that is between approximately 0.10 and 0.20 inches, and preferably approximately 0.165 inches from the hinge 146 to the score line 142. In various embodiments, and as shown in FIG.

19A, a portion of the vent score 142 is provided proximal an edge of the upstanding dome portion 144. As shown, a portion of the vent score 142 is positioned less than approximately 0.025 inches from an edge of the upstanding dome portion 144. Preferably, an edge of the upstanding dome portion 144 is provided approximately 0.014 inches from a portion of the vent score 142. As shown, the vent feature 138 generally comprises a flat oval shape with a vent hinge 146 provided between the rivet and the upstanding dome portion 144. In the depicted embodiment, the vent feature 138 is adapted to hinge inwardly toward a product side of the end closure 120 and wherein score propagation begins at a point on the vent score 142 opposite the dome portion 144 with respect to the rivet.

As further shown in FIG. 19A, the vent score 142 is provided within a secondary recess 136. In various embodiments, a distance E" is provided between an edge of the secondary recess 136 and the vent score 142. Preferably, the dimension E" comprises a distance of between approximately 0.050 and 0.10 inches, and preferably of approximately 0.073 inches. A distance F between a center point of the dome portion 144 and a portion of the vent score 142 preferably comprises a distance of between approximately 0.070 inches and 0.090 inches, and more preferably comprises a distance of approximately 0.078 inches. A distance between the vent hinge and a center point of the dome portion 144 is shown as dimension H, wherein dimension H preferably comprises a distance of between approximately 0.070 and 0.10 inches, and preferably of between approximately 0.077 and 0.087 inches. A first width G of the vent feature 138 comprises a width of between approximately 0.140 and 0.180 inches, and preferably of between approximately 0.155 and 0.165 inches. A lateral distance C is provided between a center point of the dome portion 144 and a portion of the vent score 142, wherein the lateral distance C comprises a distance of between approximately 0.140 inches and 0.180 inches, and preferably of between approximately 0.150 and 0.175 inches. The dome portion 144 comprises a width I of between approximately 0.10 and 0.20 inches, and preferably of between approximately 0.128 and 0.132 inches. The width I generally comprises a dimension across the dome portion 144 between opposing intersections of the dome portion and the vent panel. In certain embodiments, the dome portion 144 comprises a hemisphere. In such embodiments, the width I comprises a diameter of the dome portion 144. In alternative embodiments, however, it is contemplated that dome portion 144 is not a complete hemisphere and/or is provided on the vent panel such that a distance across the base of the dome portion 144 does not comprise a diameter.

FIGS. 14A-19B depict a vent feature provided within a main recess or deboss and provided in a specific location with respect to the rivet and other elements of the end closure. It will be expressly recognized that the vent feature (s) shown herein may be provided at various alternative locations on the central panel of the end closure(s). Indeed, alternative embodiments contemplate providing the vent feature and/or stiffening bead at different locations including outside of the main deboss, or wherein the bead or recess comprises an extension of the main recess. Furthermore, the present disclosure is not limited to end closures that comprise a single vent. End closures are contemplated as comprising a plurality of the vent features shown and described herein.

Figure 20:
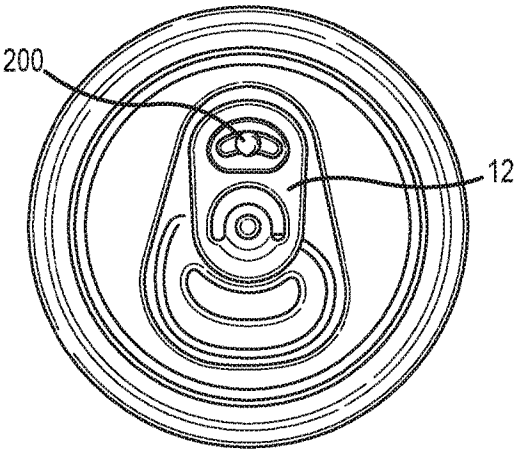
FIG. 20 is a top plan view of an end closure according to one embodiment of the present disclosure with a tab provided thereon.

FIG. 20 is a top plan view of an end closure according to one embodiment of the present disclosure with a tab 12 provided therein. The tab 12 is secured to a rivet on the end closure, and comprises an aperture 200 revealing an upstanding dome portion of a vent feature. In the closed and sealed position of FIG. 20, unwanted opening of the vent feature is avoided at least by the provision of the aperture 200. The aperture 200 also provides a visual indicia to indicate to a user that a vent feature exists beneath the tab. Opening of the vent is possible by rotating the tab 12 about the rivet and applying a downward force on the upstanding vent feature with an underside of the tail portion of the tab 12.

Figure 16A:
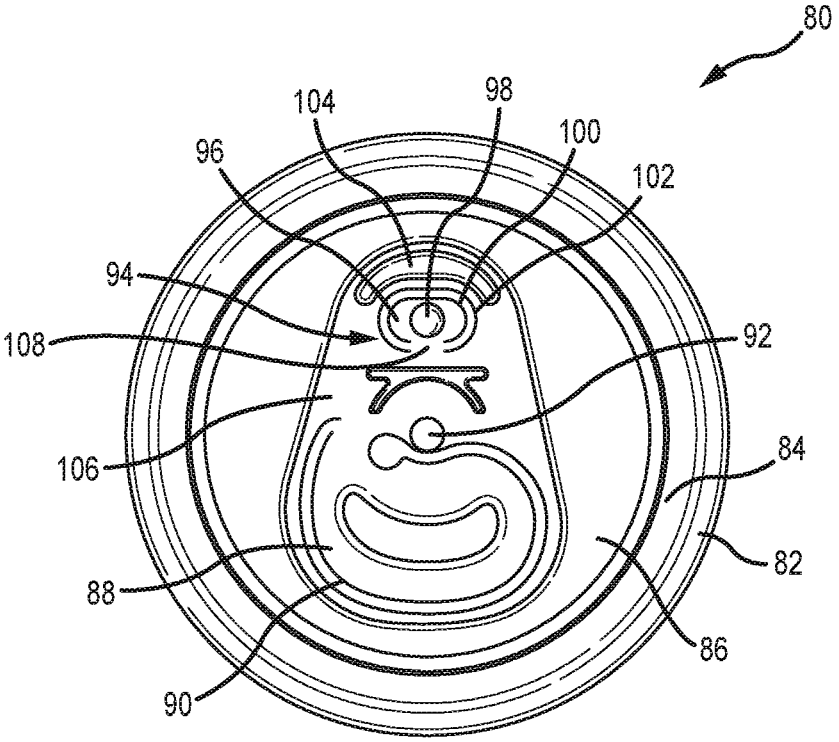
FIG. 16A is a top plan view of an end closure according to one embodiment of the present disclosure.
Figure 16B:
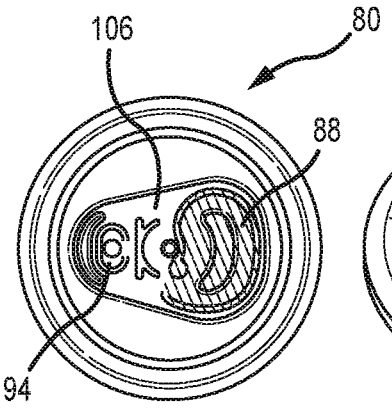
FIG. 16B is a top plan view of the end closure of the embodiment of FIG. 16A.
Figure 16C:
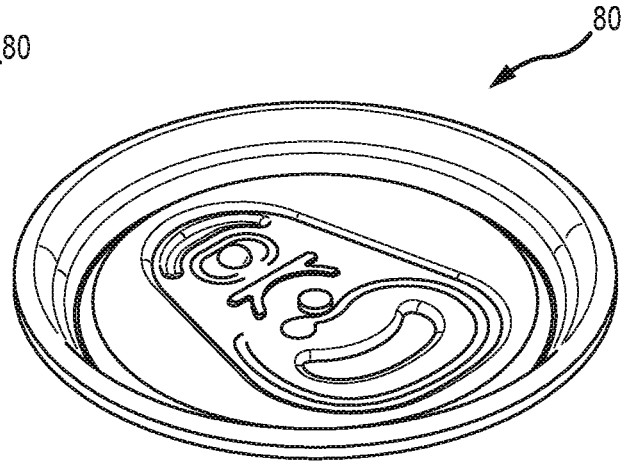
FIG. 16C is a top perspective view of the end closure of the embodiment of FIG. 16A.
Figure 22:
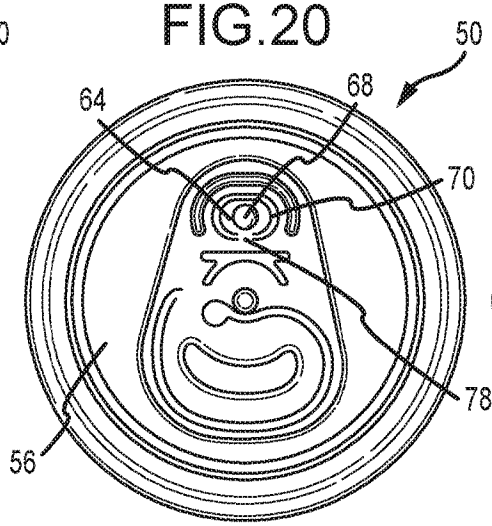
FIG. 22 is a top plan view of an end closure according to one embodiment of the present disclosure.
Figure 23:
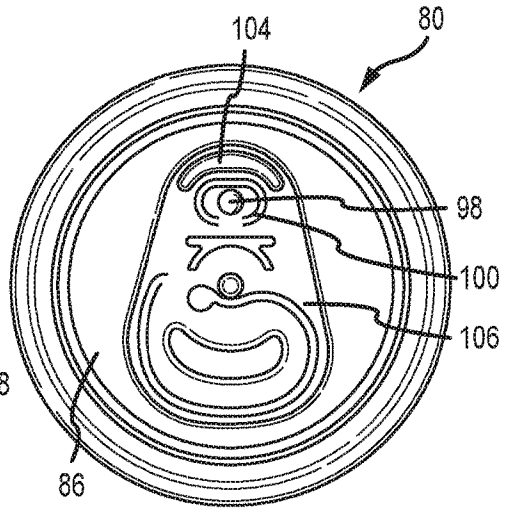
FIG. 23 is a top plan view of an end closure according to one embodiment of the present disclosure.
Figure 21:
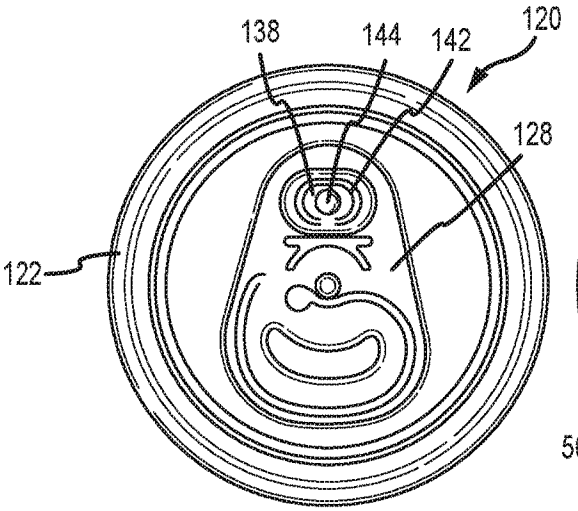
FIG. 21 is a top plan view of an end closure according to one embodiment of the present disclosure.

FIGS. 21-23 are top plan views of the end closures shown in FIGS. 18A, 14A, and 16A, respectively and without a tab provided thereon. The tab 12 of FIG. 20 may be provided on any one of the end closures shown in FIGS. 21-23.

Figure 24:
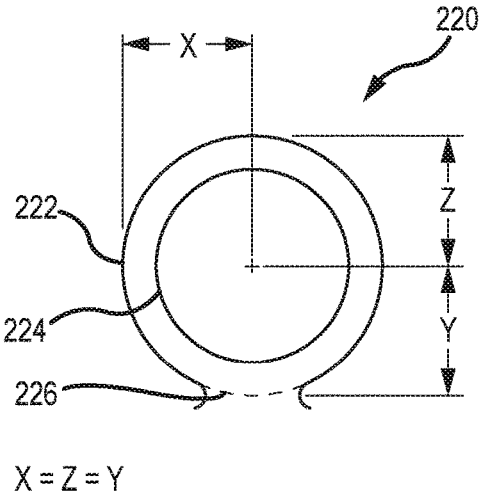
FIG. 24 is a top plan view of a vent feature according to one embodiment of the present disclosure.

FIG. 24 is a top view of a vent feature 220 according to one embodiment of the present disclosure. As shown, the vent feature 220 comprises a vent score 222 about which the vent may be separated or opened with respect to a remainder of the end closure at or about a vent hinge 226. A raised feature 224 is provided within the vent score 222 and the vent hinge 226. The raised feature 224 of the embodiment of FIG. 24 comprises a domed or partially-spherical feature extending at least partially above the vent feature 220. A perimeter line is shown in FIG. 24 to generally indicate the limits or boundary of the raised feature 224. Relative dimensions of the embodiment of FIG. 24 are provided, wherein a distance X is shown as comprising a lateral distance between a center of the raised feature and the score line 222 of the vent feature 220. A distance Y is shown and comprises a distance from the center of the raised feature 224 and the vent hinge 226. A distance Z is provided, distance Z comprising the distance between the center of the raised feature 224 and a portion of the score line 222 provided opposite the vent hinge. The embodiment of FIG. 24 comprises a vent feature 220 with a raised portion 224 and a vent hinge 226 and wherein the vent score 222 and the vent hinge 226 are provided substantially concentric with the raised feature 224. Specifically, illustrated dimensions are provided wherein X is substantially equivalent to Y and to Z.

Figure 25:
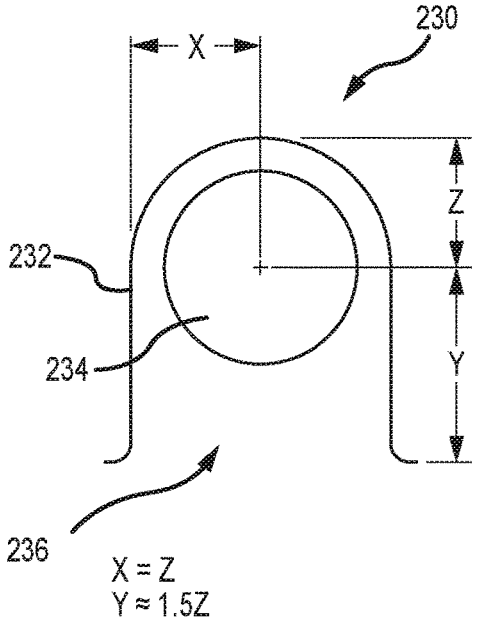
FIG. 25 is a top plan view of a vent feature according to one embodiment of the present disclosure.

FIG. 25 is a top view of a vent feature 230 according to yet another embodiment of the present disclosure. The vent feature 230 comprises a vent score 232, a raised feature 234 and a vent hinge 236. The vent feature 230 of FIG. 25 comprises an elongated vent with a distance X between a center of the raised feature 234 and a lateral portion of the vent score 232, a distance Y between a center of the raised feature 234 and the vent hinge 236, and a distance Z between a center of the raised feature 234 and a portion of the vent score 232 opposite the vent hinge. In the embodiment of FIG. 25, distance X is approximately equal to distance Z. Distance Y comprises a distance that is approximately 1.5Z. It will be recognized that distance Y may be varied based on various parameters, but preferably comprises a distance between approximately 1.2Z and 3.0Z.

Figure 26:
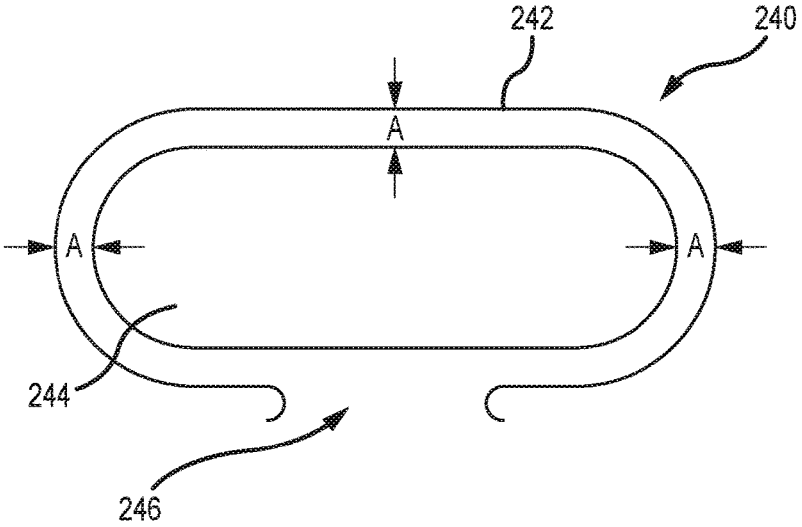
FIG. 26 is a top plan view of a vent feature according to one embodiment of the present disclosure.

FIG. 26 is a top view of a vent feature 240 according to yet another embodiment of the present disclosure. As shown, the vent feature 240 comprises a vent score 242, a raised feature 244 and a vent hinge 246. The vent score 242 and a perimeter of the raised feature 244 comprise a substantially flat oval shape. A distance A is provided, the distance A comprises a distance or spacing between the vent score 242 and a perimeter of the raised feature 244. In the embodiment of FIG. 26, the distance A is substantially constant around the perimeter of the raised feature 244.

FIGS. 24-26 depict vent features of various embodiments of the present disclosure. The vent features of FIGS. 24-26 may be provided in various locations on an end closure, including within a main deboss, external to a main deboss, and within a local recess feature (which may further be provided in various locations on the end closure).

FIGS. 27-35 depict end closures in accordance with various embodiments of the present disclosure. The various embodiments contemplate different vent features and/or stiffening beads. The features and functions of vent features and stiffening beads as described herein apply to the embodiments of FIGS. 27-35, which are provided to illustrate that various modifications to such features are contemplated. Such modifications may be desirable based on can or end closure size, aesthetic purposes, or various other reasons. FIGS. 27-35 provide various end closures 249, 251, 253, 255, 257, 261, 263, 265, 267 with various combinations of vent openings 300, 302, 304, 306, 258, 260, 308, 310, 312, 314 and secondary recesses 250, 252, 254, 256, 262, 264, 266, 268. It will be recognized that various vent openings as shown and described in this disclosure may be combined with various stiffening structures and secondary recesses shown and described herein, and that the present disclosure is not limited to the particular combinations and embodiments provided in the figures.

Figure 36:
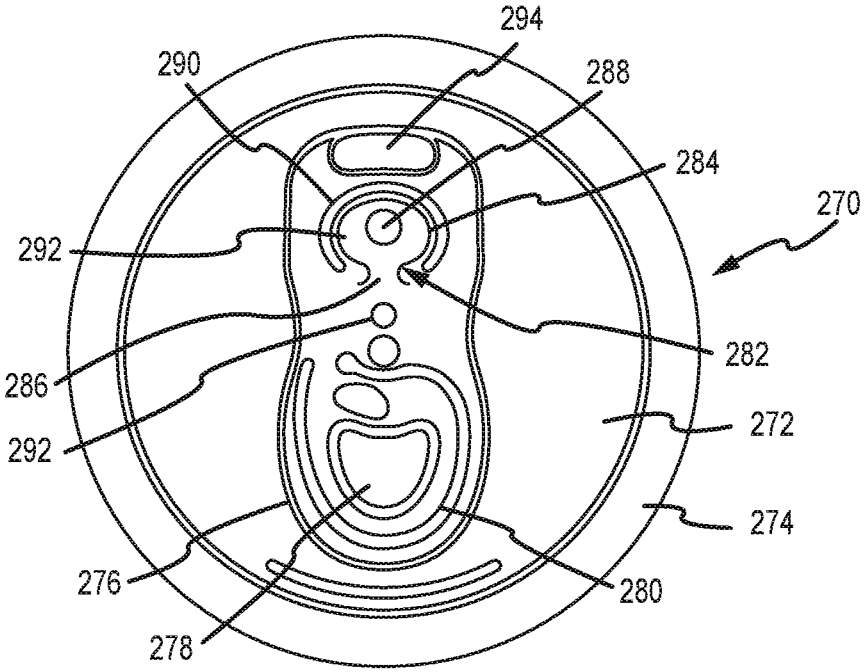
FIG. 36 is a top plan view of an end closure with a vent feature according to one embodiment of the present disclosure.

FIG. 36 is a top plan view of an end closure 270 according to one embodiment of the present disclosure. As shown, the end closure 270 comprises a central panel 272 with a peripheral curl 274 extending therefrom and wherein the end closure 270 is adapted to be secured to a container body (not shown). The central panel 272 comprises a deboss 276 within which is provided a primary opening 278 that is openable via a primary score line 280. A tab (not shown) may be attached to the central panel 272 by a rivet 292. Opposite the rivet 292 from the primary opening 278 is a vent opening 282. The vent opening 282 comprises a vent score 284 and a vent hinge 286. The vent score 284 comprises an oval or ovoid shape with various radii of curvature. The vent score 284 defines a severable score line about which the vent opening 282 can be forced open. The vent opening 282 comprises a button or domed portion 288 comprising a semi-circular member extending upwardly toward a public side of the closure. A curvilinear secondary recess 290 is provided external to and at least partially surrounding the vent feature 282 and vent panel 292. The secondary recess 290 is provided to account for slack metal, increase panel stiffness, and/or assist with opening of the vent feature 282. As shown in FIG. 36, the closure further comprises a tab access feature 294 to enhance access to an underside of a tab and assist a user in opening operations. The tab access feature 294 also provides enhanced stiffness to the panel, and in certain embodiments comprises a means for accounting for slack metal created in the manufacturing process.

The description of the present invention has been presented for purposes of illustration and description, but is not intended to be exhaustive or limiting of the invention to the form disclosed. Many modifications and variations will be apparent to those of ordinary skill in the art. The embodiments described and shown in the figures were chosen and described in order to best explain the principles of the invention, the practical application, and to enable those of ordinary skill in the art to understand the invention.

While various embodiments of the present invention have been described in detail, it is apparent that modifications and alterations of those embodiments will occur to those skilled in the art. Moreover, references made herein to "the present invention" or aspects thereof should be understood to mean certain embodiments of the present invention and should not necessarily be construed as limiting all embodiments to a particular description. It is to be expressly understood that such modifications and alterations are within the scope and spirit of the present invention.

What is claimed is:

1. A vented metallic end closure adapted for interconnection to a neck of a container body, comprising:
- a peripheral curl;
- a chuck wall extending downwardly from the peripheral curl;
- a central panel positioned within the chuck wall;
- a deboss provided on the central panel;
- a tab interconnected to the central panel and rotatable about a rivet;
- a primary score defining a dispensing opening;
- a vent opening comprising a secondary score;
- the tab comprising a nose end and a pull end, said pull end comprising an aperture, the aperture adapted to provide visual feedback of the vent opening;
- wherein the pull end of the tab is adapted to contact the vent opening, and wherein the tab is adapted to transmit a force to the vent opening and sever the secondary score;
- the secondary score comprising first and second linear portions, the first and second linear portions being substantially parallel, and first and second opposed arcuate portions;
- the vent opening provided within a recessed portion of the deboss area and comprising a raised feature and a vent hinge; and
- wherein the vent hinge is positioned such that the vent opening hinges in an opposite direction as the dispensing opening.

2. The vented metallic end closure of claim 1, wherein the aperture in the tab is larger than the raised feature of the vent opening, and smaller than the vent opening.

3. The vented metallic end closure of claim 1, wherein the raised feature comprises a convex feature positioned within the secondary score which extends toward a public side of the end closure.

4. The vented metallic end closure of claim 1, wherein the vent opening is positioned within a secondary recess and the secondary recess is provided within the deboss.

5. The vented metallic end closure of claim 1, wherein the pull end of the tab comprises a downwardly projecting portion for contacting the vent opening.

6. The vented metallic end closure of claim 1, wherein a center point of the vent opening is radially offset from a center line of the end closure by at least approximately 15 degrees.

7. The vented metallic end closure of claim 1, wherein a center point of the vent opening is provided at a lateral midpoint of the end closure.

8. The vented metallic end closure of claim 1, wherein the secondary score and the vent hinge collectively comprise a flat oval shape.

9. A vented metallic end closure adapted for interconnection to a neck of a container body, comprising:
- a peripheral curl;
- a chuck wall extending downwardly from the peripheral curl;
- a central panel positioned inwardly from the chuck wall;
- a deboss provided on the central panel;
- a tab interconnected to the central panel and rotatable about a rivet;
- the deboss comprising a dispensing opening and a vent opening;

the dispensing opening comprising a primary score line and the vent opening comprising a secondary score line and a vent hinge;

the tab comprising a nose end and a pull end;

wherein the pull end of the tab is adapted to contact the vent opening, and wherein the tab is adapted to transmit a force to the vent opening and sever the secondary score;

the secondary score comprising an oval score line at least partially surrounding a vent panel;

an upstanding dome portion provided on the vent panel, the upstanding dome portion comprising a center that is spaced apart from the vent hinge.

10. The vented metallic end closure of claim 9, wherein the secondary score line is provided beneath the tab at least when the container is in a first closed position.

11. The vented metallic end closure of claim 9, wherein the upstanding dome portion comprises a convex feature positioned within the secondary score which extends outwardly from the public side of the end closure.

12. The vented metallic end closure of claim 9, wherein a minimum distance between the upstanding dome portion and the secondary score line is at least approximately 0.010 inches and not more than approximately 0.180 inches.

13. The vented metallic end closure of claim 9, wherein the pull end of the tab comprises a downwardly projecting portion for contacting the vent opening.

14. The vented metallic end closure of claim 9, wherein a center point of the vent opening is radially offset from a center line of the end closure.

15. The vented metallic end closure of claim 9, wherein a center point of the vent opening is provided at a lateral midpoint of the end closure.

16. The vented metallic end closure of claim 9, wherein the secondary score line and vent hinge collectively comprise a flat oval shape.

17. A vented metallic end closure adapted for interconnection to a neck of a container body, comprising:

a peripheral curl;

a chuck wall extending downwardly from the peripheral curl;

a countersink interconnected to a lower end of the chuck wall;

a central panel interconnected to the countersink;

a deboss provided on the central panel;

a tab interconnected to the central panel and rotatable about a rivet;

a dispensing opening;

a vent opening;

an upstanding portion provided on the vent opening, the upstanding portion comprising a protrusion extending toward a public side of the end closure and comprising a perimeter on an upper surface of the vent opening;

the dispensing opening comprising a primary score line; and the vent opening comprising a secondary score line and a vent hinge;

a secondary recess extending at least partially around the vent opening;

the tab comprising a nose end and a pull end;

wherein the pull end of the tab is adapted to contact the upstanding portion of the vent opening, and wherein the tab is adapted to transmit a force to the upstanding portion of the vent opening and sever the secondary score;

the vent opening comprising a first dimension extending between the vent hinge and the secondary score line and a second dimension extending between opposing ends of the secondary score line, the second dimension being substantially perpendicular to the first dimension;

the first dimension comprising a distance of between approximately 0.150 and 0.170 inches; and the second dimension comprising a distance of between approximately 0.290 and 0.360 inches.

18. The vented metallic end closure of claim 17, wherein the vent opening is radially offset from a center line of the end closure.

19. The vented metallic end closure of claim 17, wherein the secondary score line and vent hinge collectively comprise a flat oval shape.

20. The vented metallic end closure of claim 17, further comprising an anti-fracture score at least partially surrounding the secondary score line.

* * * * *